US007194834B2

(12) United States Patent
Falenwolfe

(10) Patent No.: US 7,194,834 B2
(45) Date of Patent: Mar. 27, 2007

(54) FIREARM OPERATING MECHANISM AND CARTRIDGE CYLINDER ASSEMBLY

(75) Inventor: Patrick Falenwolfe, 1059 Main St., Slatington, PA (US) 18080

(73) Assignee: Patrick Falenwolfe, Slatington, PA (US)

( * ) Notice: Subject to any disclaimer, the term of this patent is extended or adjusted under 35 U.S.C. 154(b) by 26 days.

(21) Appl. No.: 10/989,980

(22) Filed: Nov. 16, 2004

(65) Prior Publication Data

US 2006/0101692 A1 May 18, 2006

(51) Int. Cl.
*F41A 3/00* (2006.01)

(52) U.S. Cl. ..... 42/19; 42/65

(58) Field of Classification Search ..... 42/59, 42/65, 19; 89/157, 4.1
See application file for complete search history.

(56) References Cited

U.S. PATENT DOCUMENTS

| | | | | | |
|---|---|---|---|---|---|
| 698 | A | * | 4/1838 | Strong | 42/61 |
| 151,882 | A | | 6/1874 | Jones | |
| 194,489 | A | | 8/1877 | Wallis | |
| 233,363 | A | * | 10/1880 | Merritt | 42/59 |
| 245,792 | A | * | 8/1881 | Cory | 42/59 |
| 719,254 | A | | 1/1903 | Parkhurst | |
| 2,237,291 | A | | 4/1941 | Carter | |
| 2,382,676 | A | | 8/1945 | Swartz | |
| RE26,534 | E | * | 3/1969 | Lewis | 42/62 |
| 3,640,013 | A | | 2/1972 | Franklin | |
| 3,744,171 | A | | 7/1973 | Fecke | |
| 3,782,359 | A | * | 1/1974 | Kester et al. | 124/48 |
| 3,892,082 | A | | 7/1975 | Domhan | |
| 4,494,332 | A | | 1/1985 | Matievich | |
| 4,918,850 | A | * | 4/1990 | Rick | 42/59 |
| 5,613,315 | A | * | 3/1997 | Hunziker | 42/65 |
| 5,727,345 | A | * | 3/1998 | Sullivan | 42/59 |
| 5,729,927 | A | | 3/1998 | Shaver, Jr. | |
| 6,047,490 | A | * | 4/2000 | Kirst | 42/59 |
| 6,397,506 | B1 | * | 6/2002 | Oglesby, Jr. | 42/59 |
| 6,481,137 | B2 | | 11/2002 | Kornberger | |
| 2002/0078614 | A1 | | 6/2002 | Kornberger | |

* cited by examiner

*Primary Examiner*—Michael J. Carone
*Assistant Examiner*—Bret Hayes

(57) ABSTRACT

A firearm includes a receiver having an opening, at least one cartridge-containing cylinder rotatably disposed within the receiver, and a hammer displaceable between cocked and strike positions. A slide is movably coupled with the receiver so as to be linearly displaceable between a front position and a rear position and displaces the hammer to the cocked position. A rotator is movably coupled with the slide and releasably engages with and rotatably displaces the cylinder when the slide displaces toward the front position and alternatively disengages from the cylinder when the slide displaces toward the rear position. Preferably, each cylinder is rotatably disposed within a chamber of a housing removably disposeable within the receiver cavity and displaceable through the receiver opening. Most preferably, at least one cylinder has chambers for receiving cartridges of a first size and another cylinder has chambers for receiving cartridges of a second, different size.

47 Claims, 13 Drawing Sheets

FIREARM OPERATING MECHANISM AND CARTRIDGE CYLINDER ASSEMBLY

BACKGROUND OF THE INVENTION

The present invention relates to firearms, and more particularly to mechanisms for operating firearms and devices for retaining cartridges.

Certain firearms include a receiver, a barrel connected with the receiver, and a rotatable cartridge-containing cylinder connected with and/or disposed within the receiver. The cylinder has a plurality of chambers for separately retaining cartridges and functions to separately align each chamber with the barrel for projecting or "firing" of a bullet through the barrel bore. Such cylinders are typically mounted on a spindle that is either fixed to the receiver or mounted on a pivotable carrier that is rotatable from out of alignment with the barrel to a position facilitating reloading of cartridges. Typically, these firearms have an operating mechanism connected with the receiver and engageable with the cylinder so as to rotate the cylinder, typically when a trigger or a hammer is pulled rearwardly, to separately position each cartridge chamber with the barrel bore.

Further, a variety of other firearm operating mechanisms are known, including pump or slide actions, bolt actions, gas-operated semi-automatic or automatic actions. Each such operating mechanism basically functions to "load" a cartridge into position for firing a bullet through the barrel, remove the spent cartridge from alignment with the barrel, and then load another cartridge.

SUMMARY OF THE INVENTION

In one aspect, the present invention is an operating mechanism for a firearm having a receiver, a cartridge-containing cylinder disposed at least partially within the receiver so as to be rotatable about an axis, and a hammer movably connected with the receiver so as to be displaceable between a cocked position and a firing pin strike position. The operating mechanism comprises a slide movably coupled with the firearm so as to be linearly displaceable between a front position and a rear position and configured to displace the hammer to the cocked position. A rotator is movably coupled with the slide and is configured to releasably engage with and rotatably displace the cylinder about the axis when the slide displaces toward the front position and to alternatively disengage from the cylinder when the slide displaces toward the rear position.

In another aspect, the present invention is a cartridge retainer assembly for a firearm having a receiver with a cavity and an opening extending into the cavity. The cartridge assembly comprises a housing removably disposeable within the receiver cavity, having an interior chamber, and being displaceable through the frame opening. A cylinder is rotatably disposed within the housing chamber and has a plurality of chambers, each chamber being configured to receive a separate cartridge.

In a further aspect, the present invention is again a cartridge retainer assembly for a firearm including a frame with a cavity and a barrel, the barrel having a rear end connected with the receiver, an opposing front end, and a bore extending between the front and rear ends. The cartridge retainer assembly comprises a first cylinder having a plurality of chambers, each first cylinder chamber being configured to receive a separate cartridge of a first size. A second cylinder has a plurality of chambers, each second cylinder chamber being configured to receive a separate cartridge of a second, different size. Further, a housing is removably disposeable within the receiver cavity and has an interior chamber configured to selectively receive one of the first and second cylinders. As such, the selected cylinder is rotatably displaceable within the housing chamber to separately position each one of the selected cylinder chambers in alignment with the barrel bore.

In yet another aspect, the present invention is a firearm comprising a receiver, a cartridge-containing cylinder disposed at least partially within the receiver so as to be rotatable about an axis, and a hammer movably connected with the receiver so as to be displaceable between a cocked position and a firing pin strike position. A slide is movably coupled with the firearm so as to be linearly displaceable between a front position and a rear position and is configured to displace the hammer to the cocked position. Further, a rotator is movably coupled with the slide and configured to releasably engage with and rotatably displace the cylinder about the axis when the slide displaces toward the front position and to alternatively disengage from the cylinder when the slide displaces toward the rear position.

In yet a further aspect, the present invention is again a firearm, the firearm comprising a receiver with an interior cavity and an opening extending into the cavity and a barrel having a rear end connected with the receiver an opposing front end, and a bore extending between the front and rear ends. A housing is removably disposeable within the receiver cavity, has an interior chamber, and is displaceable through the receiver opening. Further, a cylinder is rotatably disposed within the housing chamber and has a plurality of chambers, each chamber being configured to receive a separate cartridge and being separately alignable with the barrel bore.

BRIEF DESCRIPTION OF THE SEVERAL VIEWS OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

DETAILED DESCRIPTION OF THE INVENTION

Figure 1:
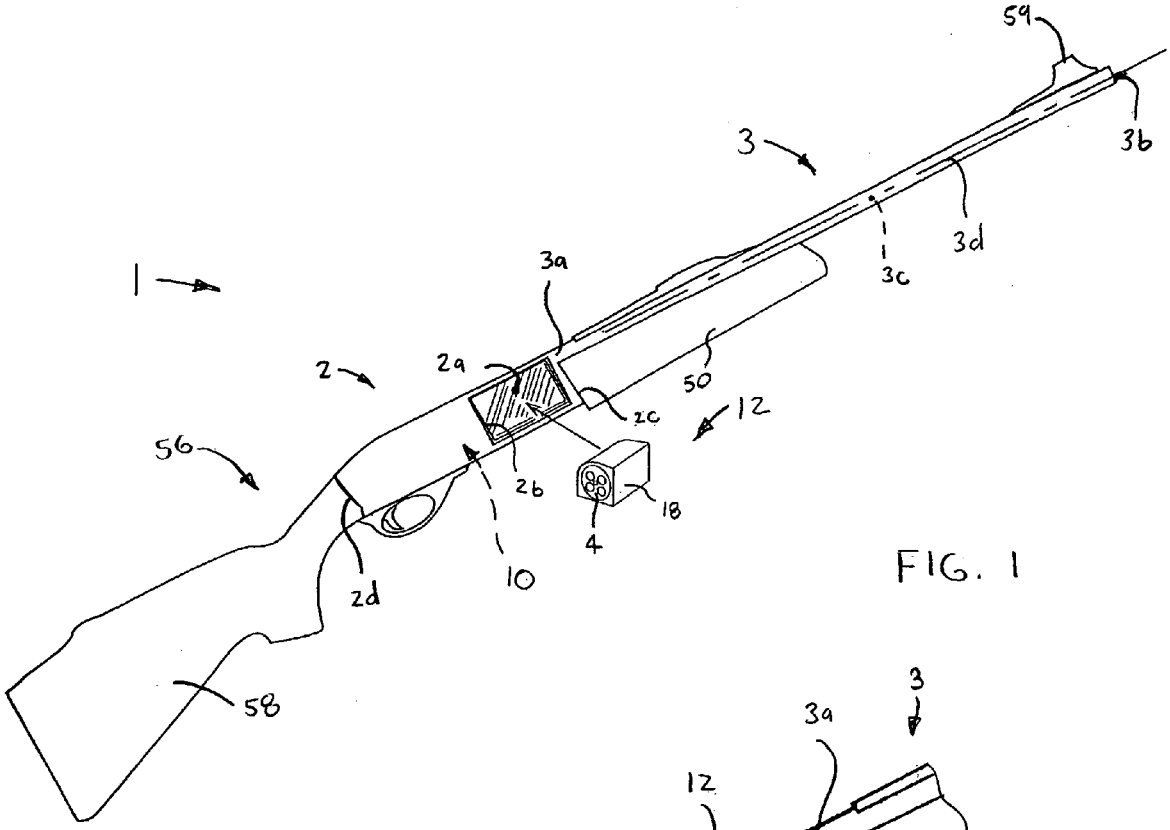
FIG. 1 is a perspective view of a firearm incorporating an operating mechanism and cartridge retainer assembly in accordance with the present invention, shown with the cartridge assembly separate from a receiver.
Figure 2:
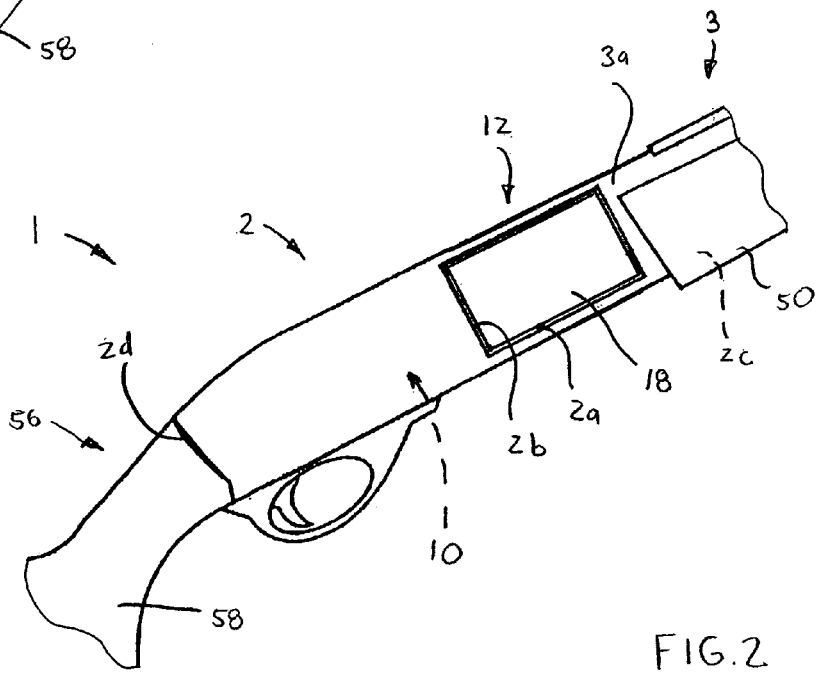
FIG. 2 is a broken-away, enlarged perspective view of the firearm of FIG. 1, shown with the cartridge retainer assembly disposed within a receiver cavity.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, a designated front end of a firearm. The words "inner", "inwardly" and "outer", "outwardly" refer to directions toward and away from, respectively, a designated centerline or a geometric center of an element being described, the particular meaning being readily apparent from the context of the description. Further, as used herein, the word "connected" is intended to include direct connections between two members without any other members interposed therebetween and indirect connections between members in which one or more other members are interposed therebetween. The terminology includes the words specifically mentioned above, derivatives thereof, and words of similar import.

Figure 3:
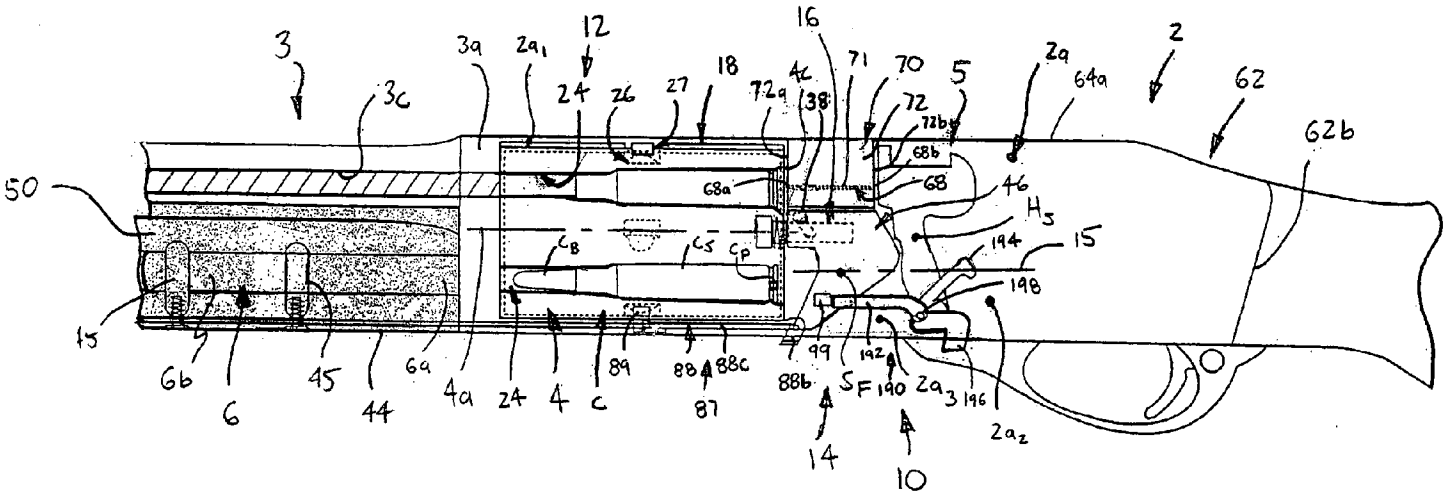
FIG. 3 is a broken-away, side elevational view of the firearm, showing the operating mechanism in a front position and a hammer in a strike position.
Figure 24:
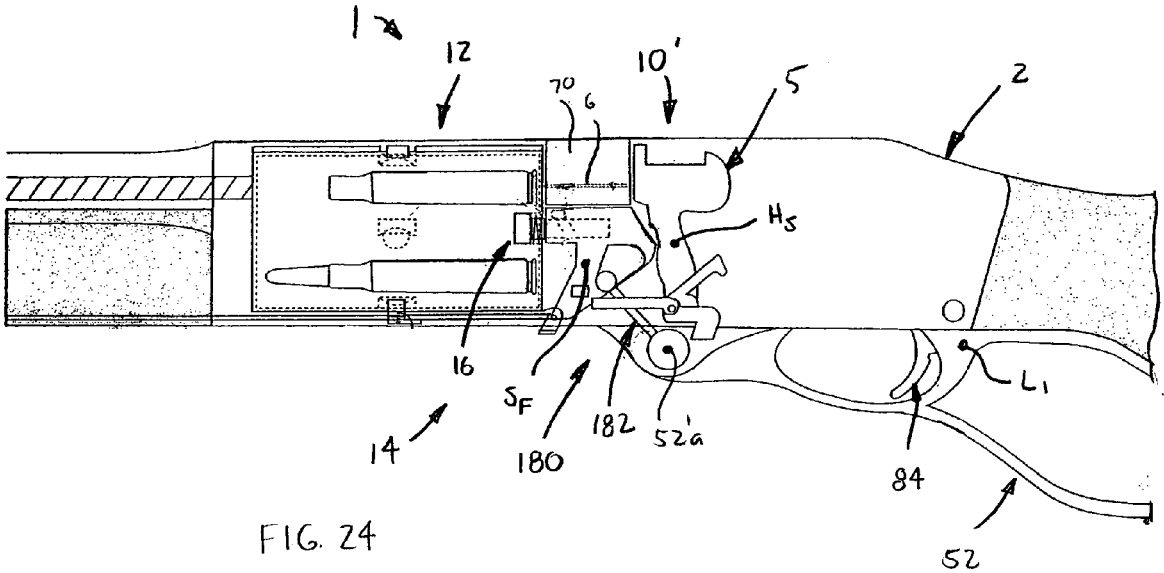
FIG. 24 is a broken-away, enlarged perspective view of the an alternative construction of the firearm, shown with a lever activated operating mechanism in the front position and the hammer in the strike position.

Referring now to the drawings in detail, wherein like numbers are used to indicate like elements throughout, there is shown in FIGS. 1–25 presently preferred embodiments of an operating mechanism 10 and a cartridge retainer assembly 12 for a firearm 1, in accordance with the present invention. The firearm 1 includes a receiver 2 with a cavity 2*a* and an opening 2*b* extending into the cavity 2*a*, a barrel 3 having a rear end 3*a* connected with the receiver 2, an opposing front end 3*b*, and a bore 3*c* extending between the ends 3*a*, 3*b* and having an axis 3*d*, a cartridge-containing cylinder 4 disposed at least partially within the receiver cavity 2*a* so as to be rotatable about an axis 4*a*, and a hammer 5 movably connected with the receiver 2 so as to be displaceable between a cocked position $H_C$ (FIGS. 4 and 25) and a firing pin strike position $H_S$ (FIGS. 3 and 24). The operating mechanism 10 basically includes a slide 14 movably coupled with the firearm 1 and a rotator 16 movably coupled with the slide 14 and engageable with the cylinder 4. The slide 14 is linearly displaceable along an axis 15 between a front position $S_F$ and a rear position $S_R$ and is configured to displace the hammer 5 to the cocked position $H_C$. Preferably, the slide 14 is configured to displace the hammer 5 to the cocked position $H_C$ when the slide 14 displaces toward the rear position $S_R$.

Most preferably, the slide 14 is contactable with the hammer 5 as the slide 14 displaces toward the rear position $S_R$ so as to push the hammer 5 to the cocked position $H_C$. However, the slide 14 may be configured to displace the hammer 5 by any other means, such as by a linkage or a gear train (e.g., pinion and rack gear) (neither shown), and/or may be configured to "cock" the hammer 5 when the slide 14 displaces toward the front position $S_F$. Further, the rotator 16 is configured to releasably engage with and rotatably displace the cylinder 4 about the axis 4*a* when the slide 14 displaces toward the front position $S_F$ and to alternatively disengage from the cylinder 4 when the slide 14 displaces toward the rear position $S_R$, as discussed in detail below.

The cartridge retainer assembly 12 basically includes a housing 18 removably disposeable within the receiver cavity 2*a* and a cylinder 4 rotatably disposed within the housing 18. Most preferably, the firearm 1 includes at least two cartridge assemblies 12, one assembly 12 including a first cylinder 20A disposed within one housing 18 and at least one other assembly 12 including a second cylinder 20B disposed within another housing 18. Alternatively, the firearm 1 may include a single cartridge assembly 12 with two or more cylinders 20A, 20B, etc., each separately and removably disposeable within a single housing 18, as discussed below. Each housing 18 has an interior chamber 22 and is slidably displaceable through the receiver opening 2*b* during installation within and removal from the receiver cavity 2*a*. Further, each cylinder 4 is rotatably disposed (or disposeable) within the chamber 22 of one housing 18 and has a plurality of chambers 24, each chamber 24 being configured to receive a separate cartridge C.

With a firearm 1 having at least two cartridge retainer assemblies 12, the first cylinder 20A has plurality of chambers 25A each configured to receive a separate cartridge $C_1$ of a first size (e.g., .308) and the second cylinder 20B has plurality of chambers 25B each configured to receive a separate cartridge $C_2$ of a second, different size (e.g., .30-06). As such, the two cylinders 20A, 20B accommodate different cartridges $C_1$, $C_2$ of the same caliber (e.g., .30 caliber). Alternatively, the cylinders 20A, 20B may be configured to accommodate cartridges C of different calibers (e.g., .22 caliber and .30 caliber) with a firearm 1 having interchangeable barrels 3 with appropriate sized bores 3*c*. Preferably, each cylinder 20A or 20B is generally fixedly retained within the particular housing chamber 22 and is rotatably displaceable therein to separately position each one of the cylinder chambers 25A or 25B in alignment with the barrel bore 3*c*, as discussed in greater detail below. Alternatively, the housing chamber 22 of a single housing 18 may be configured to selectively receive either one of the first and second cylinders 20A, 20B, or even third, fourth, fifth, etc. cylinders (none shown).

More specifically, a particular cylinder 4 is disposed adjacent to the barrel rear end 3*a* and the rotator 16 is configured to successively align each cylinder chamber 24 with the barrel bore 3*c*. That is, the rotator 16 displaces the cylinder 4 by a predetermined angular displacement $A_D$ during each engagement with the cylinder 4 so as to move one cylinder chamber 24 out of alignment with the barrel bore 3*c* and to subsequently position an adjacent cylinder chamber 24 into alignment with the barrel bore 3*c*. The cylinder 4 has a particular number of chambers 24, for example four or six chambers, and the angular displacement $A_D$ has a value of about three hundred sixty degrees divided by the particular number, i.e., ninety degrees for a cylinder 4 with four chambers 24 (360/4=90), sixty degrees for a cylinder 4 with six chambers 24, etc. Further, the cylinder 4 has a plurality of index openings 26 and the housing 18 and/or the slide 14 has a retainer lug 27 separately engageable with each one of the index openings 26 to releasably retain a separate, "live" one of the cylinder chambers 24 aligned with the barrel bore 3*c*. Specifically, the one or two lugs 27 are each disposeable within one index notch 26 associated with the particular live chamber 24 in alignment with the bore 3*c* so as to fix the angular position of the cylinder 4 about the axis 4*a*, and thus ensure that the bore/chamber alignment is maintained, as discussed in further detail below.

Figure 5:
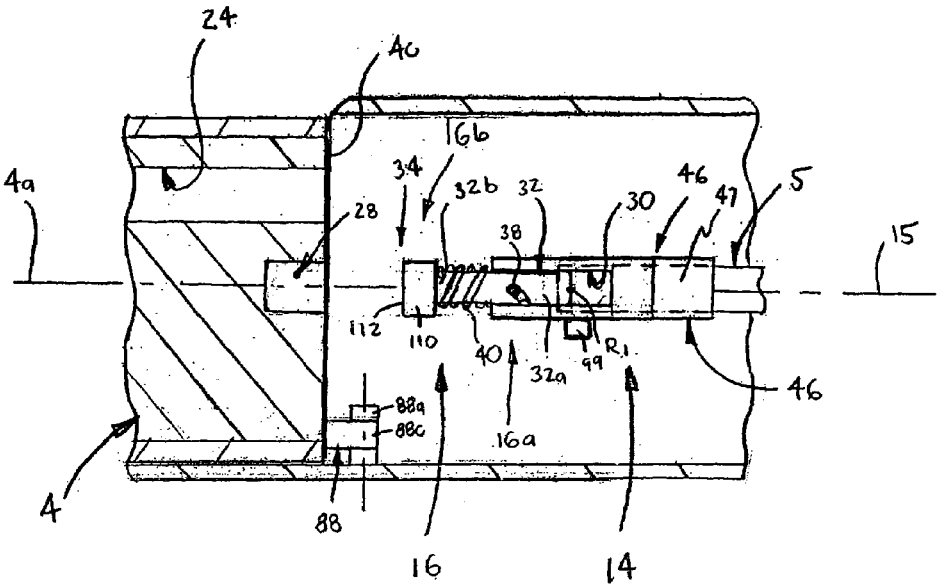
FIG. 5 is a broken-away, cross-sectional view within a generally horizontal plane through the operating mechanism and cylinder, showing the slide in the rear position.
Figure 6:
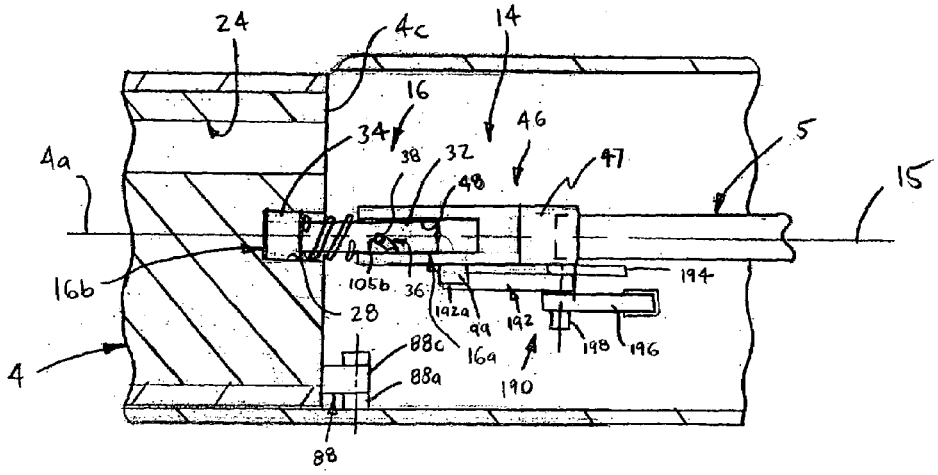
FIG. 6 is another view of the firearm of FIG. 5, showing the slide in an intermediate position.

Further, the rotator 16 has a first portion 16*a* coupled with the slide 14 and second portion 16*b* releasably engageable with the cylinder 4, preferably with an engagement opening 28 thereof, as indicated in FIGS. 5 and 6. The rotator 16 is preferably configured to linearly and rotatably displace with respect to the slide 14, when the rotator 16 is engaged with the cylinder 4, such that the rotator 16 angularly or rotatably displaces the cylinder 4 as the slide 14 displaces toward the front position $S_F$. Preferably, the slide 14 includes a bore 30 and the rotator 16 includes a rod 32 having a first end 32*a* movably disposed within the slide bore 30 and an opposing second end 32*b*. The rotator 16 also includes a head 34 connected with the rod second end 32*b*, the head 34 being removably disposeable at least partially within the cylinder opening 28 to releasably couple the rotator 16 with the cylinder 4. With this structure, the rod 32 linearly and rotatably displaces with respect to slide 14 when the head 34 is engaged with the cylinder opening 28, such that the head 34 rotatably displaces the cylinder 4 about the cylinder axis 4*a* as the slide 14 linearly displaces toward the front position $S_F$.

Figure 7:
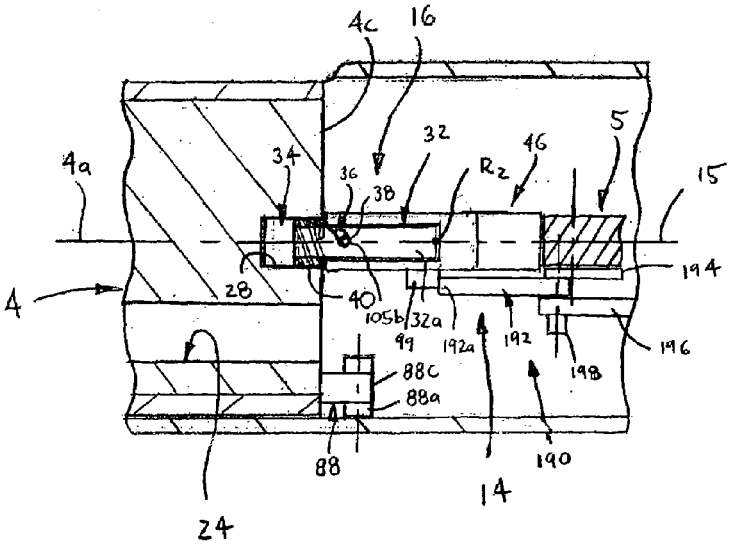
FIG. 7 is another view of the firearm of FIG. 5, showing the slide in the front position.
Figure 8:
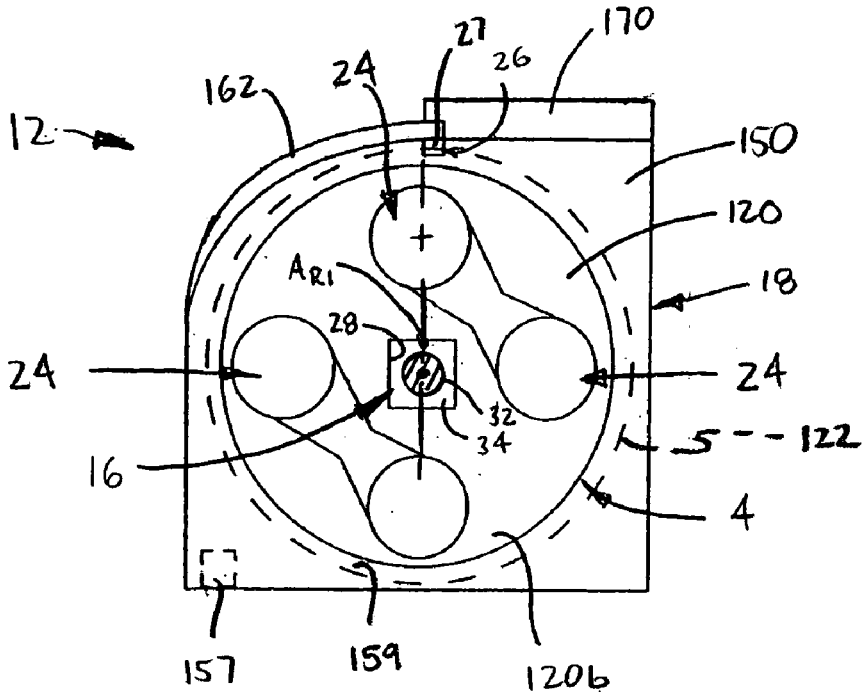
FIG. 8 is a rear elevational view of a cylinder and a front portion of a rotator, shown with a first chamber aligned with a barrel bore.
Figure 9:
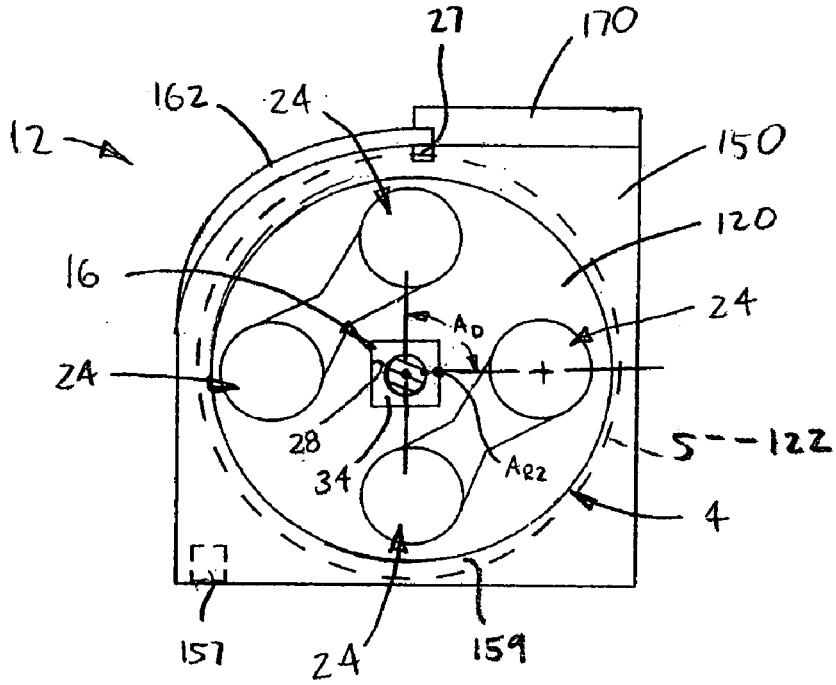
FIG. 9 is another view of the elements of FIG. 8, shown with a second cylinder chamber aligned with the barrel bore.

Furthermore, the rod 32 preferably has a central axis 33 and is displaceable with respect to the slide 14 between first and second linear positions $R_1$, $R_2$ and rotatably displaceable between first and second angular positions $A_{R1}$, $A_{R2}$ about the rod axis 33. The rod 32 is configured to displace between the first and second angular positions $A_{R1}$, $A_{R2}$ when displacing with respect to the slide 14 between the rod first and second linear positions $R_1$, $R_2$. More specifically, when the slide 14 displaces toward the front position $S_F$ with the head 34 in engagement with the cylinder opening 28, the rotator 16 remains disposed generally at a fixed position with respect to the slide axis 15 as the rod 32 is displaced with respect to the moving slide 14 from the first linear position $R_1$ (FIGS. 5 and 6) to the second linear position $R_2$ (FIG. 7). Such relative linear motion between the rod 32 and slide 14 causes the rod 32 to rotate from the first angular position $A_{R1}$ (FIG. 8) to the second angular position $A_{R2}$ (FIG. 9) to thereby rotatably displace the cylinder 4.

Preferably, either the rotator rod 32 or the slide 14 has a camming surface 36 and the other one of the rod 32 and slide 14 includes a follower 38, the follower 38 being contactable with the camming surface 36 such that linear displacement of the slide 14 with respect to the rod 32 rotatably displaces the head 34, as discussed above and in further detail below. Furthermore, the head 34 preferably engages with the cylinder opening 28 when the slide 14 is disposed at an intermediate position $S_1$ (see FIG. 6) during displacement from the rear position $S_R$ and toward the front position $S_F$, and disengages from the cylinder opening 28 when the slide 14 displaces from the front position $S_F$ and toward the rear position $S_R$. Additionally, the operating mechanism 10 preferably further comprises a biasing member 40 configured to bias the rod 32 toward the first linear position $R_1$ when the head 34 is disengaged from cylinder opening 28. As such, the rod 32 displaces with respect to the slide 14 from the second linear position $R_2$ to the first linear position $R_1$ as the slide 14 displaces toward the rear position $S_R$.

Further, the slide 14 preferably includes an elongated rod portion or "rod" 44 displaceably connected with the firearm 12 and a block portion or "block" 46 contactable with the hammer 5. The slide rod 44 has a first, front end 44*a* slidably connected with either the receiver 2 or with the barrel 3 and an opposing second, rear end 44*b* connected with the block 46. The rod 44 extends generally parallel with respect to the bore axis 3*d* and is disposed generally beneath the barrel 3 and the cylinder 4 (i.e., when the firearm 1 is positioned in a firing orientation). Most preferably, the firearm 1 further includes an elongated guide member 6 connected with the receiver 2 and extending generally parallel with respect to, and located beneath, the barrel 3. The slide rod first end 44*a* is slidably connected with the guide member 6, preferably by means of at least one and preferably two ring coupling members 45, as described below. Furthermore, the slide block 46 has a hole 48 configured to receive at least a portion of the rotator 16, which thus provides the slide bore 30 as discussed above, and a drive surface 47. The block drive surface 47 is contactable with the hammer 5 to push the hammer 5 to the cocked position $H_C$ when the slide 14 displaces in the rearward direction $S_R$, as discussed above and in further detail below.

Preferably, the receiver interior cavity 2*a* has three sections: a first cavity section $2a_1$ configured to receive the cylinder 4, a second cavity section $2a_2$ configured to receive at least the hammer 5, and a third cavity section $2a_3$ disposed generally between the first and second cavity sections $2a_1$, $2a_2$ and configured to receive the slide block 46. The slide block 46 is displaceable within the third or "intermediate" cavity section $2a_3$ between a proximal position (FIG. 3) with respect to the cylinder 4, i.e., when the slide 14 is at the front position $S_F$, and a distal position (FIG. 4) with respect to the cylinder 4, i.e., when the slide 14 is located at the rear position $S_R$. As such, the rotator 16 is engaged with the cylinder 4 at the proximal position and the block 46 is in contact with the hammer 5 at the distal position, as discussed in greater detail below.

Additionally, the operating mechanism 10 preferably further comprises a grip 50 connected with the slide 14, most preferably with the rod 44, and configured to be grasped by a user such that the slide 14 is manually displaceable between the front and rear positions $S_F$, $S_R$. Thus, a user pulls the grip 50 rearwardly to move the slide 14 to the rear position $S_R$, and thus the block 46 to the distal position, so as to "cock" the hammer 5. Then, the user pushes the grip 50 forwardly to move the slide 14 to the front position $S_F$, and the block 46 to the proximal position, to releasably engage the rotator 16 with the cylinder 4 and subsequently rotate the cylinder 4 about axis 4*a*. Alternatively, the operating mechanism 10 may comprise a lever 52 (FIGS. 24 and 25) pivotally coupled with the receiver 2 and configured to displace the slide 14 between the front and rear positions $S_F$, $S_R$, as described in further detail below.

With the basic structure as described above, the operating mechanism 10 and the cartridge retainer assembly 12 provides the capability of using different sized cartridges in a single firearm 1, as well as a unique process of rapid conversion between such different cartridges. Further, the operating mechanism 10 also enables the firearm 1 to have a rapid operating cycle, specifically the time to remove a fired or "spent" cartridge C from alignment with the barrel bore 3*c* and to position another cartridge C in alignment therewith, while simultaneously cocking the hammer 5. Such operating cycle is substantially faster in comparison to conventional pump action, lever action or bolt-action mechanisms, primarily due to the relatively short travel distance $D_S$ (FIG. 4) of the slide 14, preferably between about one inch and two inches (1"–2"), as discussed in further detail below. Having described the basic elements of the operating mechanism 10 and retainer assembly 12 above, these and other components of the novel firearm 1 of the present invention are discussed in greater detail below.

Referring first to FIGS. 1, 2, 10 and 11, the operating mechanism 10 and the cartridge retainer assembly 12 of the present invention are both preferably incorporated into firearm 1 that is configured as a rifle 56. The preferred rifle 56 has a barrel 3 with at least sixteen inches (16") of length (i.e., along axis 3*d*) attached to a front end 2*c* of the receiver 2 and further includes a stock 58 attached to a rear end 2*d* of the receiver 2, and may also include a pistol grip (not shown). However, the firearm 1 may alternatively be a short-barreled rifle ("SBR"), a shotgun, another type of smooth bore firearm, or even a pistol without a stock (none shown). Further, the rifle 56 also includes a fire control group 80, which is preferably connected with the receiver 2 and includes the hammer 5 and other components, as described below. Additionally, the rifle 56 may also include "iron" sights 59 mounted on the barrel 3 and the receiver 2 and/or a base (not shown) for an optical scope mounted on the receiver 2.

Figure 10:
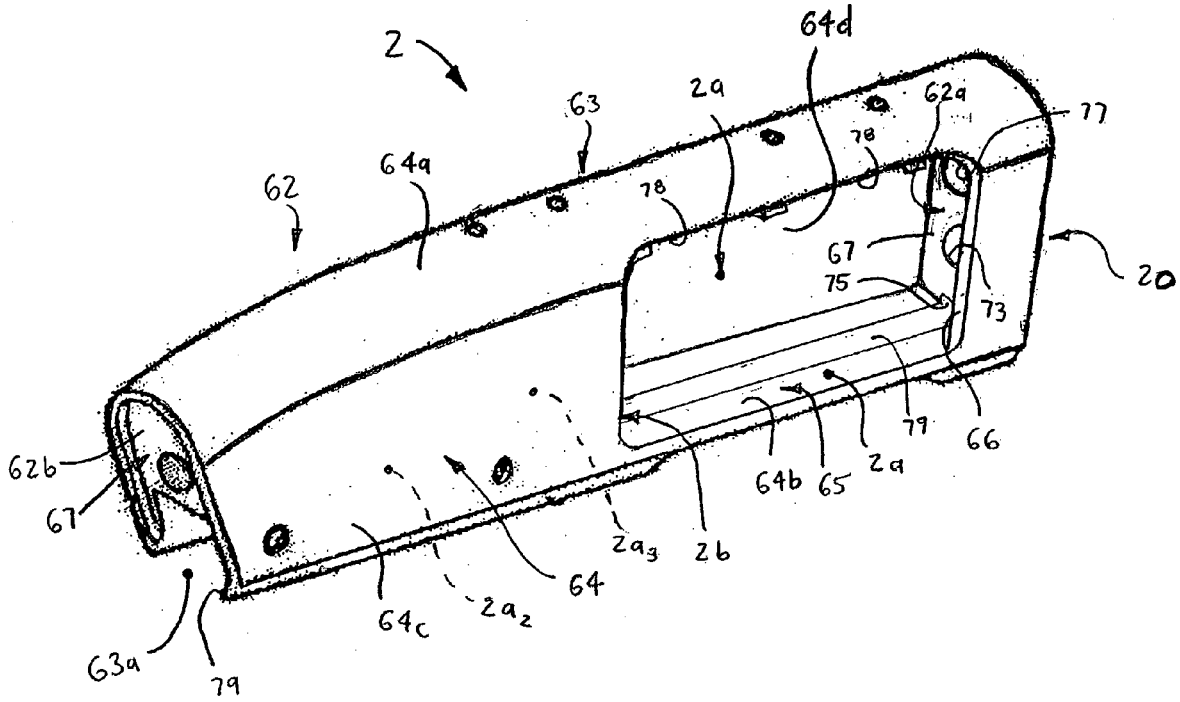
FIG. 10 is a side perspective view of the receiver.

As best shown in FIG. 10, the receiver 2 includes a generally rectangular, hollow body 62 having a front end wall 62*a* configured to receive the barrel 3, a rear end wall 62*b* configured to receive the stock 58 and at least one sidewall 64. The sidewall 64 extends between the front and rear ends 62*a*, 62*b* and has top, bottom, right and left wall portions 64*a*, 64*b*, 64*c* and 64*d*, respectively, which collectively enclose the cavity 2*a*. The receiver cartridge opening 2*b* is preferably provided by a generally rectangular hole 66 extending through the sidewall 64, preferably through the right wall portion 64*c*, that is sized to receive the cartridge retainer housing 18 for installation and removal of the cylinder 4, as discussed above and in further detail below. Preferably, the receiver body 62 is formed of a U-shaped bended plate 63 providing the top, left and right wall portions 62*a*, 62*c*, 62*d*, a flat elongated plate 65 attached to a portion of plate open end 63*a* and providing the bottom wall portion 62*b*, and two flat, rectangular plates 67 attached to front end rear ends of the bended plate 63 and providing the front and rear walls 62*a*, 62*b*.

Although the above-described "hollow box" receiver 2 is presently preferred, the receiver body 62 may be formed having any other appropriate structure, such as generally cylindrical, generally solid, formed of two or more frames or solid members as opposed to single main body, and/or may be fabricated in any other appropriate manner, such as machined from a solid block, forged and finish machined, cast, etc. The scope of the present invention includes these and all other structures of the receiver 2 capable of functioning with the operating mechanism 10 and/or the cartridge retainer assembly 12 as described herein.

Further, the receiver 2 also preferably includes a firing pin block or "bolt" 70 disposed within the cavity 2*a* and having a through bore 71 sized to receive a firing pin 68. The bolt 70 is preferably formed as a generally rectangular block 72 disposed within the cavity 2*a*, most preferably within the third or intermediate cavity section $2a_3$, and is preferably fixedly attached to the receiver body 62, most preferably to the inner surface of the top wall portion 64*a*. The bolt block 72 has a front end 72*a*, which is disposed adjacent to and preferably in contact with a portion of the cylinder rear end 4*c* (see e.g., FIG. 3), as discussed below, a rear end 72*b* that is contactable by the hammer 5 and a lower surface 72*c* extending between the ends 72*a*, 72*b* beneath which the preferred slide block 46 reciprocates. The firing pin 68 is disposed within the bolt bore 72 and has a front end 68*a* impactable with a cartridge primer $C_P$ and a rear end 68*b* strikeable by the hammer 5, as indicated in FIG. 3. The pin 68 is slidably displaceable between a rear position, in which the rear end 68*a* extends at least partially beyond the bolt rear end 72*b*, and a front position at which the pin front end 68*a* is contactable with the cartridge primer $C_P$. Preferably, the bolt 70 includes a biasing member (not shown), preferably a coil spring, disposeable at least partially about the firing pin 68 and configured to bias the pin 68 toward the rear position. As such, the pin 68 is thereby positioned by the biasing member to be driven by the hammer 5 into the cartridge primer $C_P$.

Figure 16:
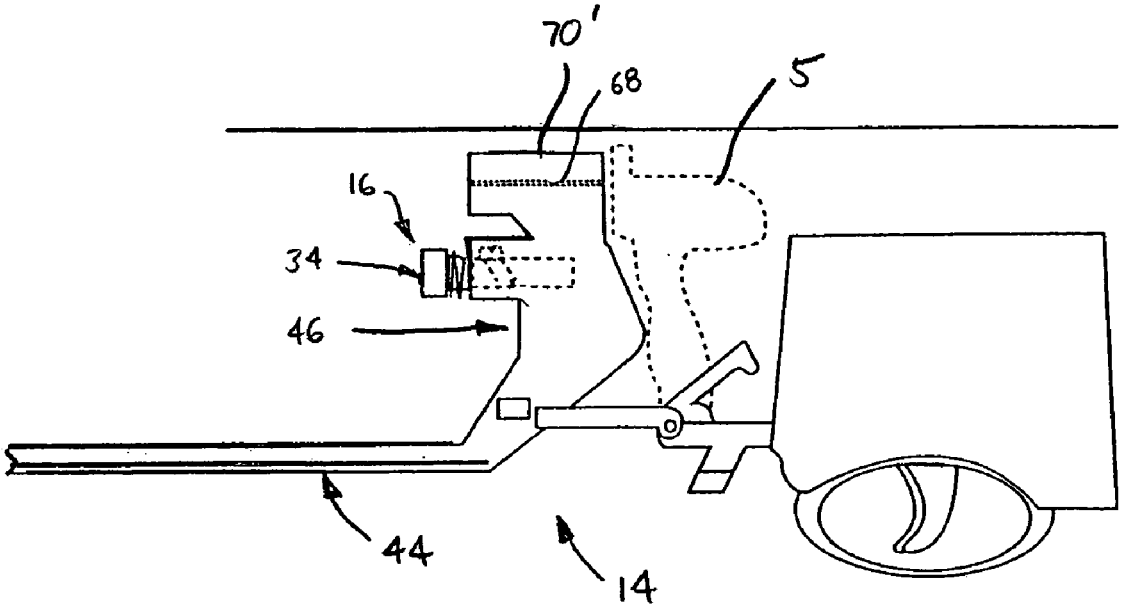
FIG. 16 is a broken-away, side elevational view of an alternative construction of the operating mechanism.
Figure 17:
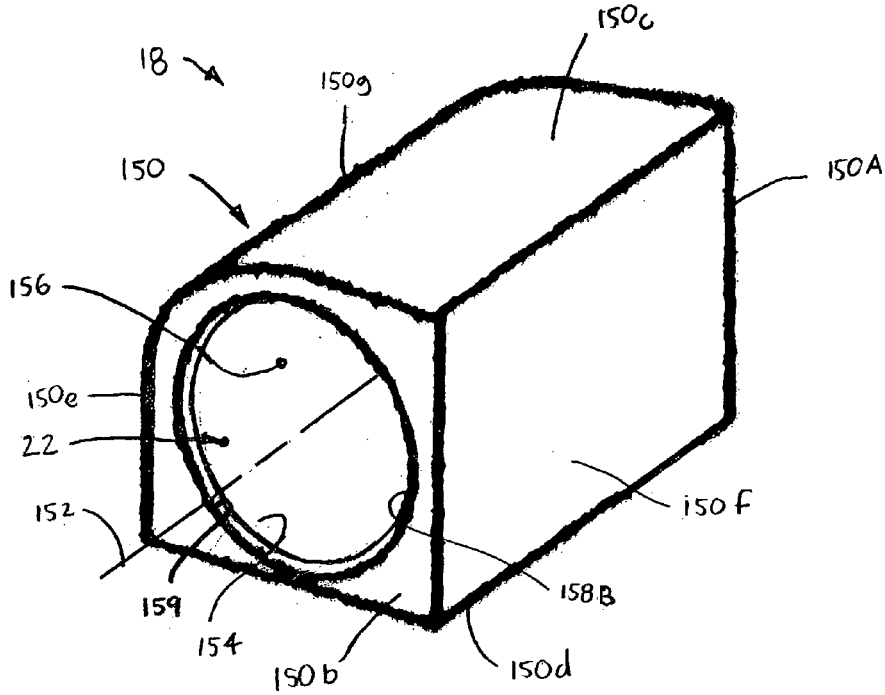
FIG. 17 is a perspective view of the cartridge retainer assembly.

Alternatively, the bolt 70 may be integrally connected or formed with the slide block 46, as shown in FIG. 16. In such a construction, the bolt 70 displaces with the slide 14 between the front and rear positions $S_F$, $S_R$, such that the block front end 72*a* is positioned adjacent to or against a portion of the cylinder 4 when the slide 14 is located at the front position $S_F$. Furthermore, the bolt 70 may be constructed in any other appropriate manner and the scope of the present invention is in no manner limited by the particular structure thereof.

Referring again to FIG. 10, the receiver 2 also includes a generally circular barrel opening 77 extending through the body front wall 62*a* and configured to receive the rear end 3*a* of the barrel 3. A second circular guide opening 73 extends through the front wall 62*a* so as to be spaced beneath the barrel opening 77 and is configured to receive a rear end 6*a* of the guide member 6, and a generally rectangular slide opening 75 configured to provide clearance for the slide 14, as discussed below, is disposed beneath the guide opening 73. Additionally, the receiver 2 preferably includes one or more locating slots 78 each configured to receive a separate indexing bar 170 of the cartridge retainer assembly 12, so as to locate the housing 18 at a desired position within the receiver cavity front section 2*a*, and to prevent inadvertent assembly of an incorrect retainer assembly 12, as described in further detail below. Furthermore, the receiver 2 also preferably includes a fire control group opening 79 extending through the bottom wall portion 64*b* and configured to receive a portion of the fire control group 80, as described below. Although the receiver 2 includes other features, such as mounting holes or tangs for connecting the stock, an opening for a trigger, etc., a description of such features is unnecessary for a clear understanding of the present invention and are therefore beyond the scope of this disclosure.

Figure 4:
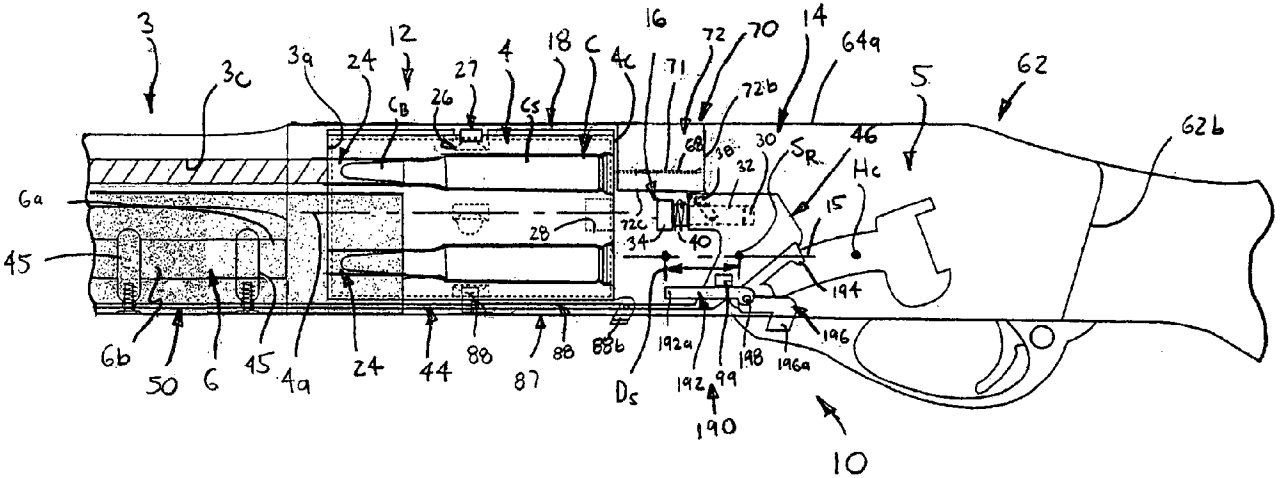
FIG. 4 is another view of the firearm of FIG. 3, showing the operating mechanism in a rear position and a hammer in a cocked position.
Figure 11:
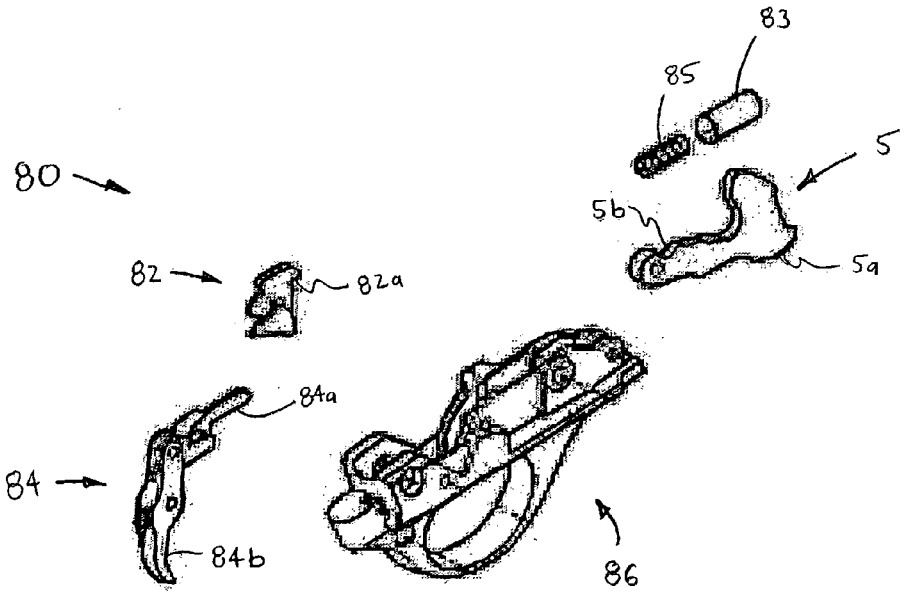
FIG. 11 is an exploded view of a fire control assembly.
Figure 12:
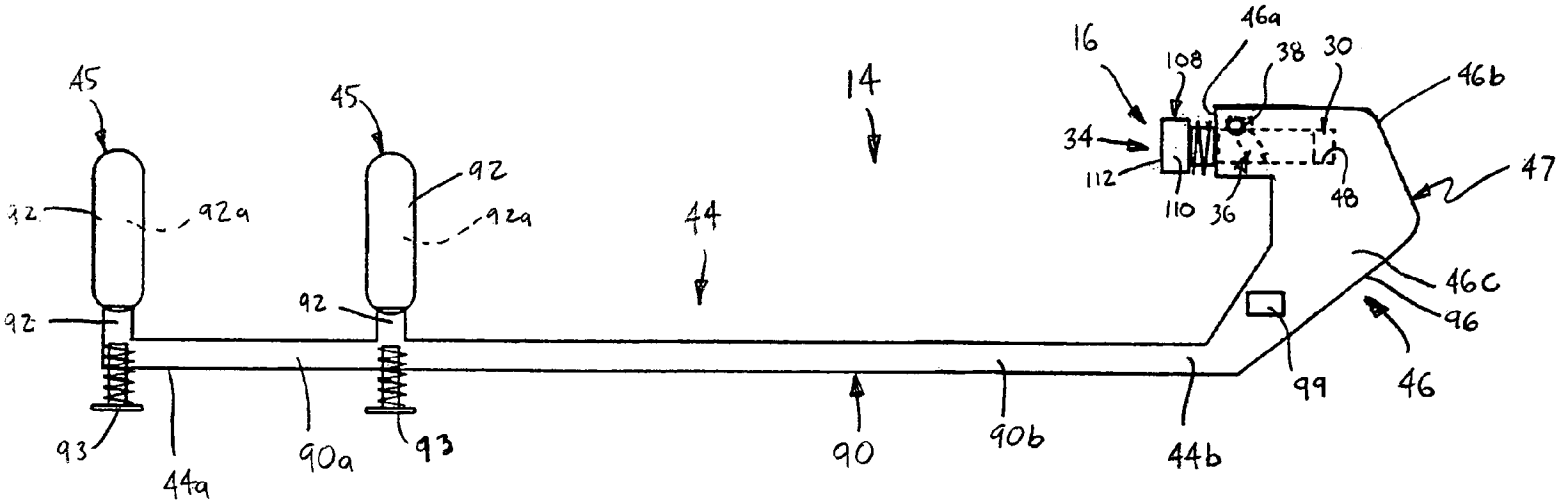
FIG. 12 is a side elevational view of the operating mechanism.
Figure 13:
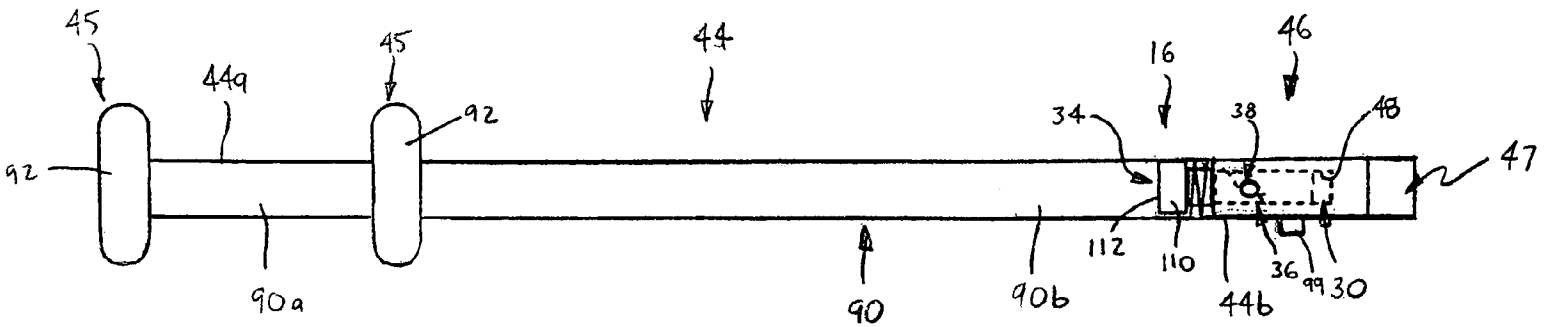
FIG. 13 is a top elevational view of the operating mechanism.
Figure 14:
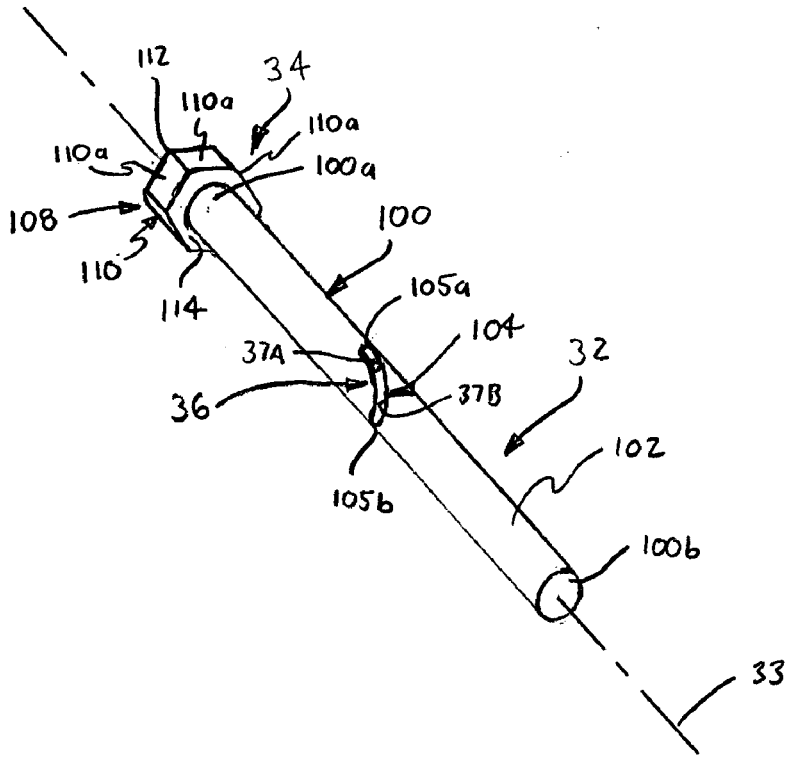
FIG. 14 is a rear perspective view of a rotator, shown with an alternative head construction.

Referring to FIGS. 3, 4 and 11, as discussed above, the hammer 5 is part of a fire control group 80 that further includes a sear 82 and a trigger 84, and preferably also includes a base block 86 to which each of the components 5, 82 and 84 are mounted. Although a detailed description of the fire control group 80 is not required for an understanding of the present invention, a brief description of these components is provided below for a more thorough understanding of the operation of the firearm 1, and particularly the operating mechanism 10 incorporated therein. More specifically, the hammer 5, the sear 82, and the trigger 84 are each pivotally connected with the base block 86 by separate pins (not indicated). The hammer 5 has a drive surface 5*a* configured to impact and the firing pin 68 when the hammer 5 is located at firing pin strike position $H_S$ and a catch surface 5*b* engageable by the sear 82, as discussed below. Preferably, a plunger 83 is biased by a spring 85 against the hammer rear surface 5*c*, such that the plunger 83 and spring 85 push the hammer 5 toward the strike position $H_S$ when released by the sear 82. Further, the sear 82 has a catch portion 82*a* engageable with the hammer catch surface 5*b* so as to retain the hammer 5 at the cocked position $H_C$. The sear 82 is pivotable between an engaged position, at which the catch portion 82*a* retains the hammer 5, and a disengaged position at which the hammer 5 is released and is biased toward the engaged position by a spring (not indicated). Furthermore, the trigger 84 preferably has a sear engagement portion 84*a* configured to pivot the sear 82 to the disengaged position, so as to thereby release the hammer 5, and a finger engagement portion 84*b* contactable by a user's finger to pivot the trigger 84 and thereby the sear 82 and hammer 5.

Although the above-described construction is presently preferred, the firearm 1 of the present invention may have a fire control group 80 with any other appropriate structure that at least includes a hammer 5 or another appropriate striker device. For example, the fire control group 80 may be constructed without a base block 86, such that each of the preferred components 5, 82, 84 may be directly pivotally connected with the receiver 2 (e.g., the left and right side wall portions 64*c*, 64*d*) by pins 81 or any other means. Further for example, the hammer 5 may alternatively be slidably connected with the receiver 2 so to be linearly displaceable between the cocked and strike positions $H_C$, $H_S$. The firearm 1 of the present invention may include these or any other appropriate constructions of the fire control group 80 and the scope of the present invention is in no manner limited by the particular structure thereof.

Referring to FIGS. 3–7, 21 and 22, the firearm 1 also preferably includes a cartridge assembly locking mechanism 87 including a pivotable bar 88 with a locking lug 89 engageable with an opening 157 in the cartridge retainer housing 18. The bar 88 has a hub portion 88*a* pivotally disposed within the receiver cavity central section $2a_3$, a lever 88*b* extending through the receiver bottom wall portion 64*b*, and an elongated rod 88*c* from the hub 88*a* and into the cavity first section so as to be disposed generally beneath the cartridge housing 18. The locking lug 89 is attached to the front end of the bar 88*a* and is disposeable at least partially within the housing lock opening 157 to releasably retain the cartridge assembly within the housing, a spring (not shown) biasing the front end of the bar 88*c* upwardly toward the housing 18 to engage the lug 89 within the opening 157. When it is desired to remove the cartridge assembly 12 from the receiver 2, the lever 88*b* is pulled rearwardly to pivot the front end of the rod 88*c* downwardly against the spring 89, thereby removing the lug 89 from the housing opening 157. The assembly 12 may then be slided out of the receiver 2 through the cartridge opening 2*b*.

Referring now to FIGS. 3, 4, 12 and 13, the slide rod 44 is preferably formed as a generally rectangular bar 90 that extends through the receiver slide opening 79, such that a bar front section 90*a* is disposed externally of the receiver 2 and a rear portion 90*b* is disposed within the cavity 2*a*. More specifically, the bar front section 90*a* extends beneath guide member 6 and the bar rear section 90*b* extends beneath the cylinder housing 18 to the slide block 46. The rod front section 90*a* further includes at least one and preferably two longitudinally spaced-apart mounting blocks 92 each configured to attach a separate ring coupling member 45 with the rod 44, preferably by means of weldment material. As such, the slide 14 is releasably connectable with the guide member 6 by the coupling members 45 being slidably disposed about the rod outer surface 6*b*. Each coupling member 45 includes a generally annular body 92 with a circular bore 92*a* through which extends a portion of the guide member 6. With this structure, when the slide 14 displaces between the front and rear positions $S_F$, $S_R$, the rings 45 slide upon the guide outer surface 6*b* to restrain the slide 14 to move along the axis 15, which extends generally parallel with respect to the barrel bore 3*c*. Additionally, two threaded fasteners 93 each extend into the rod front section 90*a* beneath a separate one of the two mounting blocks 92 and are used to removably attach the grip 50 to the slide 14.

Further, the slide rod 44 may include a spring-loaded tab (not shown) providing one retainer lug 27 (discussed above) that is movably attached to the bar 90 and removably disposeable within each one of the indexing notches 26 when the slide 14 is located in the front position $S_F$. Such engagement of the tab and notch 26 prevents the cylinder 4 from rotatably displacing about the cylinder axis 4*a*, and thus maintains one chamber 24 aligned with the barrel bore 3*c*. However, the slide 14 may be constructed without the tab (as depicted), such that the cylinder 4 is retained solely by a lug 27 movably connected with the cartridge housing 18, as described below.

Figure 15:
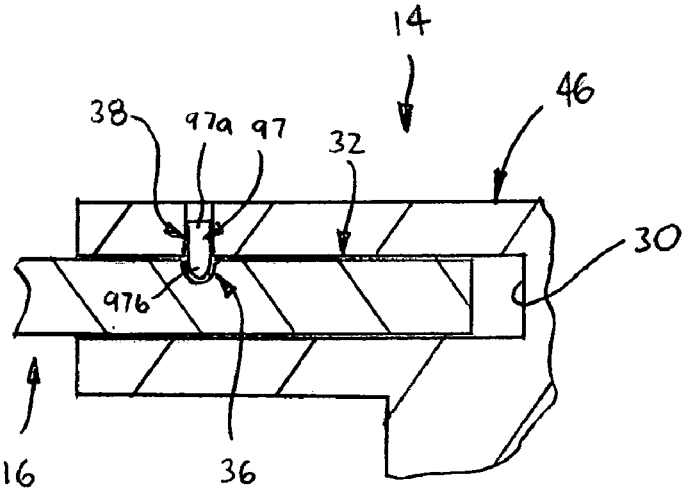
FIG. 15 is a greatly enlarged, broken away vertical cross-sectional view through the slide block and rotator.

Furthermore, the slide block 46 has a front end 46*a* and a rear end 46*b*, the block hole 48 extending inwardly from the front end 46*a* and toward the rear end 46*b* and being configured to receive a portion of the rotator 16, as described above and in further detail below. Preferably, the slide block 46 includes a pin 97 providing the follower 38 and extending generally radially into the bore 30, as best shown in FIG. 15. The pin 97 has a first end 97*a* connected with the block 46 and a second end 97*b* contactable with the camming surface 36 of the rotator 16 when the rotator rod 32 is disposed in the slide bore 30, as described below. Further, the slide block drive surface 47 (discussed above) is provided on the rear end 46*b* and is contactable with the hammer 5 to displace the hammer 5 to the cocked position $H_C$ when the slide 14 displaces toward the rear position $S_R$. Additionally, the block rear end 46*b* preferably has a lower angled section 96 providing a portion of the drive surface 47 and clearance to permit the rear portion of the block 46 to pass over the hammer 5 when moving to the slide rear position $S_R$. Furthermore, a generally rectangular stop lug 99 extends laterally from one lateral side surface 46*c* of the slide block 46 and is engageable by a slide locking mechanism 190, as described below.

Preferably, the slide rod 44 and slide block 46 are integrally formed, such that the slide 14 is machined, forged, cast, etc., as a single piece or plate of material, preferably a metallic material such as steel or aluminum. However, the rod 44 and block 46 may alternatively formed of two separate pieces that are connected together by any appropriate means, such as a threaded connection, weldment material, fasteners, a bracket, etc., and/or may be formed of any other appropriate material and in any other appropriate process, such as for example, molded of a polymeric or ceramic material. Further, although the firearm 1 preferably includes a separate bolt 70 fixedly attached to the receiver 2, the slide 14 may include an upper bolt portion 70' connected with the slide block 46 and generally formed as described above, as depicted in FIG. 16. As such, the bolt 70 and firing pin 68 move with the slide 14 and are positioned adjacent to the cylinder rear end when the slide 14 is located at the front position $S_F$.

Referring now to FIGS. 3–9 and 12–15, the rotator head 34 is formed as a polygonal cylindrical block 108 sized substantially radially larger, and axially shorter, than the rotator rod 100, but may alternatively be of approximately equal or lesser radial size and/or generally equal or greater axial length as the rod 100. The head block 108 has a generally polygonal outer surface 110 having a number of outer surface sections 110*a* corresponding to an equal number of the inner surface sections 126*a* of the cylinder opening 28, the head and opening surfaces 110, 126*a* interacting to rotate the cylinder 4, as described below. Further, the head block 108 has a front end 112 disposeable against a radial section of the cylinder opening 28 and a rear end 114 attached to the front end 100*a* of the rod 32.

Furthermore, the rotator rod 32 preferably includes a generally circular bar 100 (i.e., having circular cross-sections) having front and rear ends 100*a*, 100*b*, the rod axis 33 extending between the ends 100*a*, 100*b*, and an outer circumferential surface 102 extending about and along the axis 33. A generally helical recess 104 extends radially inwardly from the outer surface 102 and circumferentially about and linearly along the rod axis 33 between opposing ends 105*a*, 105*b*. Also, the recess 104 provides the camming surface 36, specifically two generally parallel, facing camming surfaces 37A, 37B. The slide pin second end 97*b* is disposed within the recess 104 when the rotator rod 32 is assembled within the slide bore 30. As such, relative motion between the slide 14 and the rod 32, as discussed above, causes the pin 97 to push against at least one of the two camming surfaces 37A, 37B, forcing the rod 32 to rotate as the pin 97 slides against the surface(s) 37A or/and 37B, as described in further detail below.

With the above-described structure, when the rotator head 34 is engaged with the cylinder opening 28, displacement of the slide 14 toward the front position $S_F$ causes the pin 97 (which displaces with the slide 14 along axis 15) to push against the front camming surface 37A while the rod 32 remains at a fixed linear position with respect to the axis 15. Such interaction between the linearly displacing pin 15 and the camming surface 37A forces the rod 32 to angularly displace about the rod axis 33 until the pin 97 moves from the first recess end 105*a* to the second recess end 105*b*. As such, the rod 32 rotatably displaces from the first angular position $A_{R1}$ (FIG. 8) to the second angular position $A_{R2}$ (FIG. 9) through the predetermined angular displacement $A_D$, as discussed above. At this point, further displacement of the slide 14 along the slide axis 15 is prevented, preferably both by contact between the pin 97 and slot end 105*b* and contact between the slide front end 46*a* and the cylinder rear end 120*b*.

Referring now to FIGS. 18–23, each cylinder 4 of the cartridge retainer assembly 12 includes a generally circular cylindrical block 120 with front and rear axial ends 120*a*, 120*b*, the cylinder axis 4*a* extending centrally and longitudinally through the block 120 between the two axial ends 120*a*, 120*b*, and an outer circumferential surface 122 extending about the axis 4*a*. Each cylinder chamber 24 is provided by a separate borehole 124 extending completely through the block 120 between the two ends 120*a*, 120*b* and having a central axis 125 extending generally parallel with respect to the cylinder axis 4*a*. The plurality of chambers 24 are spaced-apart circumferentially about the axis 4*a* so as to be separated from each other by substantially equal angular segments (e.g., four chambers 24 are spaced by 90° segments, six chambers 24 by 60° segments, etc.).

Figure 20:
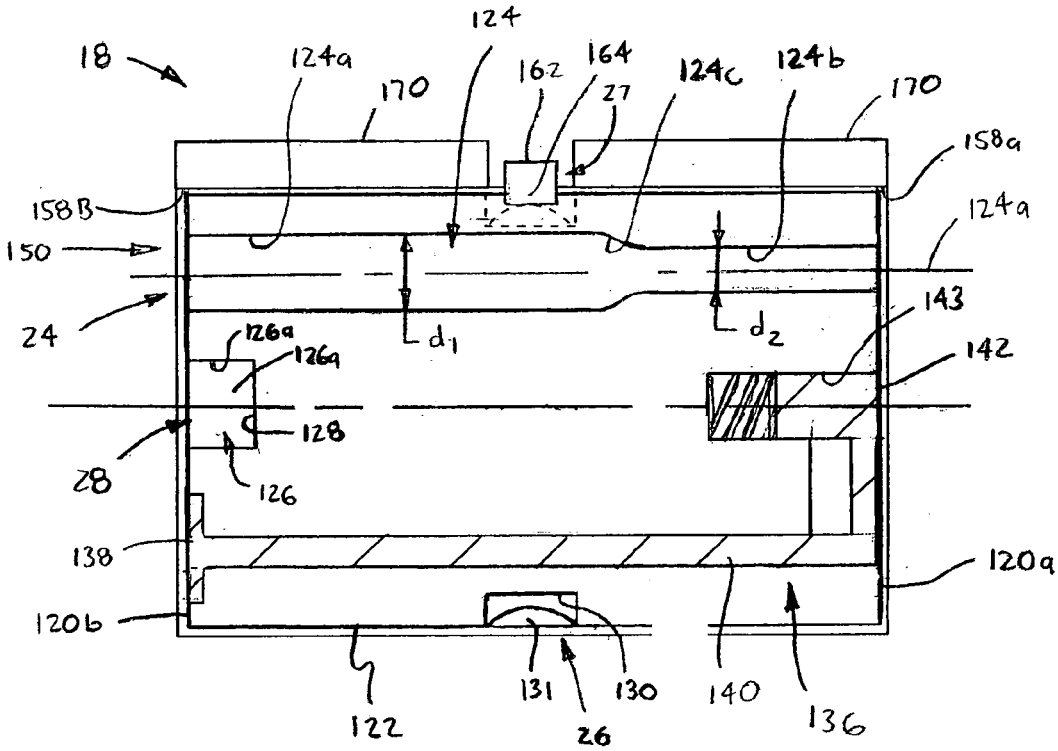
FIG. 20 is a vertical cross-sectional view through the cartridge retainer assembly.

Further, each chamber bore hole 124 includes a first, rear chamber portion 124*a* configured to receive a cartridge case $C_S$ and a second, front portion 124*b* sized to receive a cartridge bullet $C_B$ (see FIGS. 3 and 4). The second, front or "bullet" chamber portion 124*b* preferably has a lesser inside diameter $d_2$ than the inside diameter $d_1$ of the first or "case" chamber portion 124*a*, as indicated in FIG. 20. Such a chamber construction is preferred to accommodate modern rifle cartridges (e.g., .308, .3006, etc.), which typically have a cartridge case $C_C$ with a greater outside diameter than the outside diameter of the associated bullet $C_B$. As such, each chamber borehole 124 preferably further has a central, tapered portion 124*c* extending between the front and rear portions 124*a*, 124*b* to conformed to the "necked" section of such cases $C_S$. However, the chamber boreholes 124 of a particular cylinder 4 may alternatively have a generally constant inside diameter $d_1$ at all points along the axis 24 extending throughout the chamber 24 to accommodate certain cartridges (e.g., .30 caliber) having bullets $C_B$ sized only slightly lesser outside diameter than the casing CS, in which case the cylinder chambers 24 are formed generally similar to the chambers of a typical revolver cylinder (not shown).

Furthermore, each one of the plurality of chambers 24 of a single cylinder 4 is preferably formed substantially identically as each other cylinder 4, i.e., with substantially the same borehole dimensions. As such, all the chambers 24 of one particular cylinder 4 preferably accept only the same, single cartridge size (e.g., all .308 cartridges). However, a cylinder 4 may alternatively be formed with chambers 24 of two or more different dimensions so as to be configured to accept multiple cartridge sizes. For example, a cylinder 4 may be formed with four chambers 24, two chambers 24 sized to receive .308 cartridges and two chambers 24 sized to receive .3006 cartridges.

Figure 18:
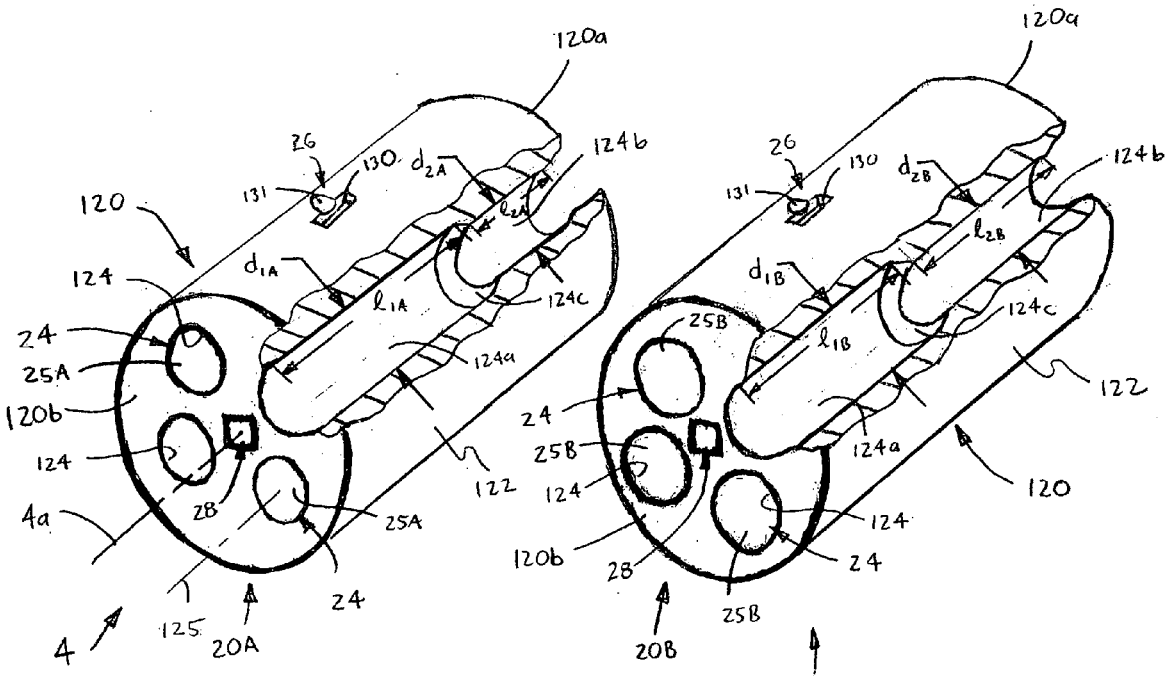
FIG. 18 is a partly broken-away, perspective view of two alternative cylinder constructions, each being adapted for a different cartridge caliber.

Referring specifically to FIG. 18, as discussed above, the firearm 1 preferably includes at least two cylinders 20A, 20B for different sized cartridges, each having a plurality of chambers 25A, 25B, respectively, constructed of varying of chamber portion dimensions, and may include three or more different cylinders 20A, 20B, 20C, etc. Specifically, each cylinder 20A, 20B, etc., of a particular firearm 1 preferably has chambers 25A, 25B with generally equal bullet chamber portion diameters $d_{2A}$, $d_{2B}$, respectively, so as to accommodate bullets of substantially the same caliber. As such, the two cylinders 20A, 20B are configured to contain cartridges C that are "fireable" through the same barrel bore 3*c*. However, the case chamber diameters $d_{1A}$, $d_{1B}$ and/or chamber portion lengths $1_{1A}$, $1_{1B}$ and $1_{2A}$, $1_{2B}$ vary to accommodate the different sized cartridges.

Figure 19:
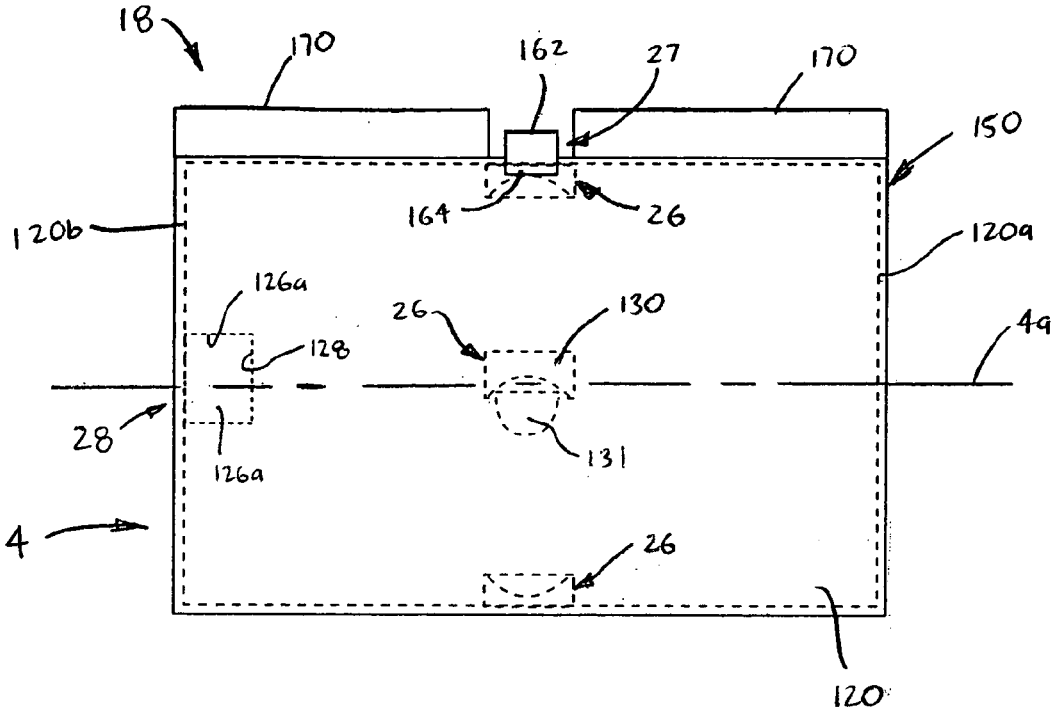
FIG. 19 is a side elevational view of the cartridge retainer assembly.
Figure 22:
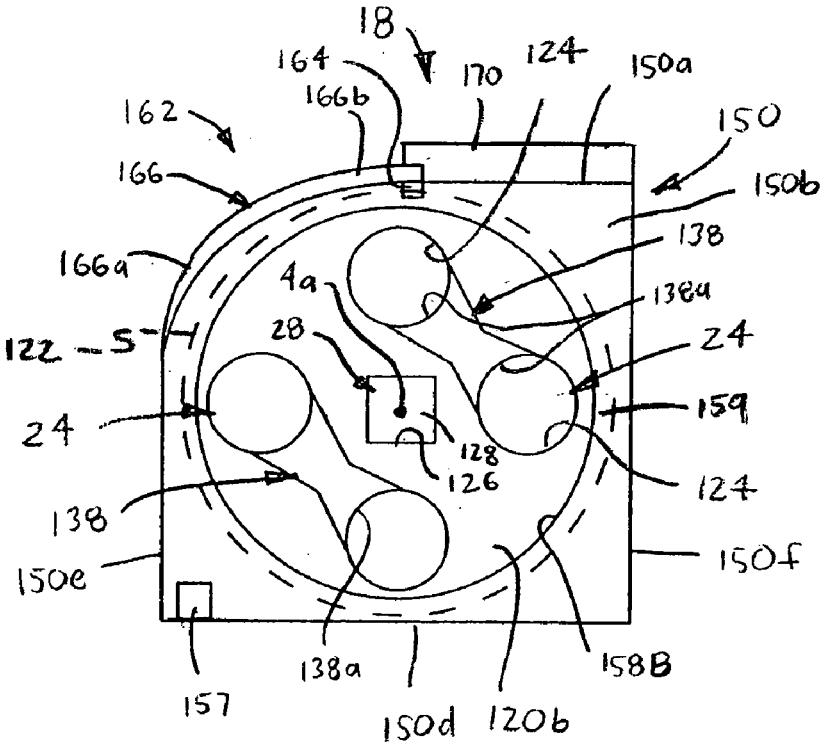
FIG. 22 is a rear elevational view of the cartridge retainer assembly.
Figure 23:
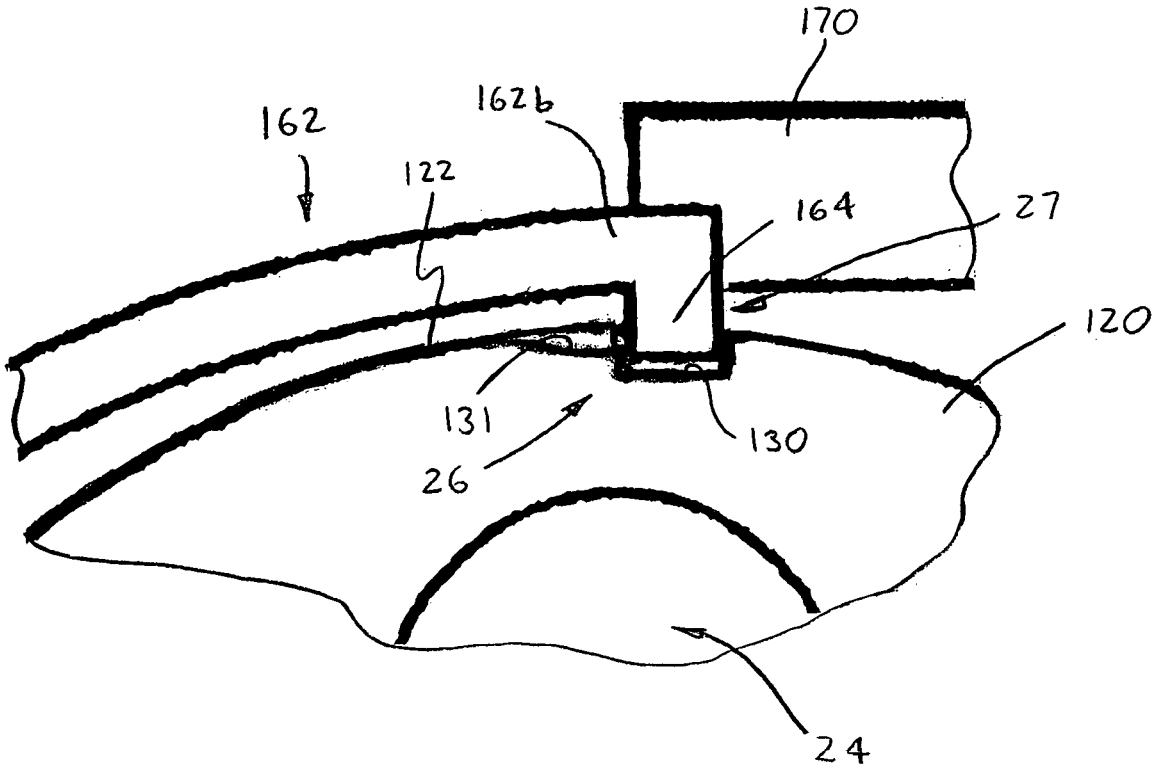
FIG. 23 is a broken-away, enlarged cross-sectional view of the cartridge retainer assembly, showing a retainer lug disposed within an index opening.

Referring to FIGS. 19, 20 and 22, the cylinder engagement opening 28, as discussed above, preferably extends into the block rear end 120*b* and is configured to receive the rotator head 34. Preferably, the engagement opening 28 is bounded by both a generally polygonal inner circumferential surface 126 extending about the axis 4*a* and having a number of side surface sections 124*a*, the number being equal to the number of chambers 24, and a radial end surface 128. As such, when the rotator head 34 is engaged with the opening 28, each rotator head outer surface section 110*a* is disposed generally against a separate one of the engagement opening side surfaces 126*a*, and the head front end 112 is disposed generally against the opening radial end surface 128. With this structure, angular displacement of the rotator 16 is transferred through the head 34 to the cylinder 4 by the interaction between the head surfaces 110*a* and the cylinder opening side surfaces 126*a*.

Referring now to FIGS. 18–20, the cylinder block 120 also preferably has a plurality of generally rectangular recesses 130 radially-inwardly from the block outer surface 122 and spaced circumferentially about the cylinder axis 4*a* and a plurality of angled lead-out surfaces 131 each extending from a separate recess 130 to the block outer surface 122. Each rectangular recess 130 provides an index opening 26 (described above) and is configured to receive a portion of one of the retainer lugs 27, either a locator lug 164 of a housing locator member 162 (described below) or the spring-loaded tab (not shown) on the slide 14 (as discussed above), so as to maintain the cylinder 4 at a fixed angular position about the axis 4*a*. Specifically, each index recess 130 is located with respect to a separate one of the chambers 24 such that when at least one lug 27 is engaged within a recess 130, the chamber 24 associated with that particular recess 130 is aligned with the barrel bore 3*c*. When the cylinder 4 has an even number of chambers 24 (e.g., four, six, etc.), the cylinder block 120 preferably has a number of recesses 130 that is equal to the number of chambers 24. However, when the cylinder 4 has an odd number of chambers 4 (e.g., three, five, seven, etc.), the cylinder block 120 is preferably provided with a number of recesses 130 equal to twice the number of chambers 24, such that the housing locator lug 164 (and potentially also the slide tab (not shown)) are each able to engage a separate index recess 130 when each one of the chambers 24 is separately aligned with bore 3*c*. Further, the lead-out surfaces 131 each function to displace the locator lug 164 from the associated indexing recess 130 to permit rotation of the cylinder 4, as described in further detail below.

With the structure described above, when at least one lug 27 is engaged with one index recess 130, the cylinder 4 is maintained at a fixed angular position about the axis 4*a*, with one chamber 24 in alignment with the barrel bore 3*c*, and is thus prevented from rotatably displacing. As such, when the rotator head 34 has been withdrawn from the engagement opening 28, the lugs 27 hold the cylinder 4 generally stationary about the axis 4*a* so that the cylinder opening 28 will remain aligned for re-engagement with the head 34 when the slide 14 returns to the front position $S_F$. Otherwise, the rotator head 34 may be prevented from entering the opening 28 due to misalignment.

Figure 21:
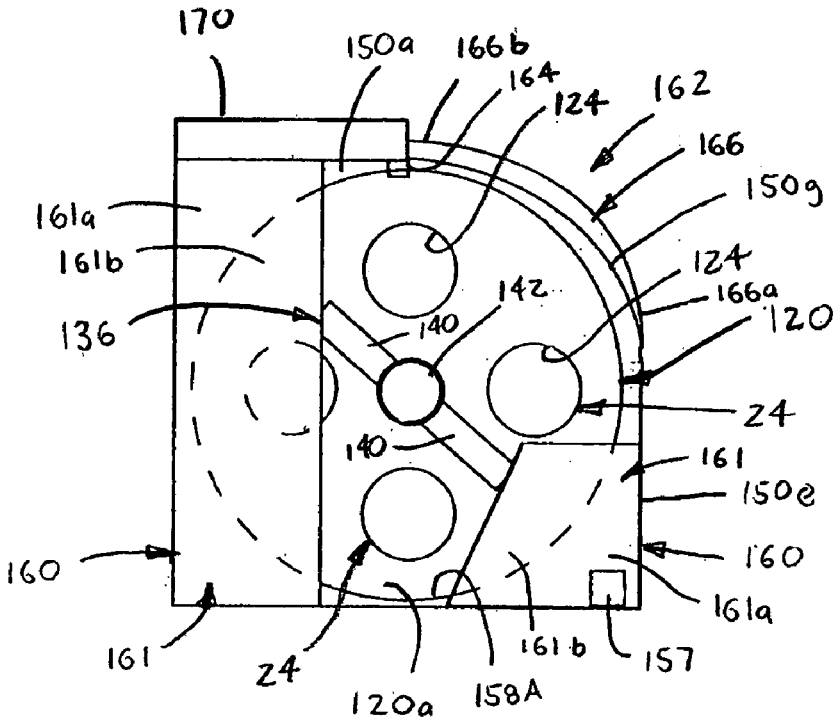
FIG. 21 is a front elevational view of the cartridge retainer assembly.

Referring to FIGS. 20–22, each cylinder 4 preferably further includes an extractor mechanism 136 configured to remove the plurality of cartridges C from the chambers 24. The extractor mechanism 136 includes at least one and preferably two engagement plates 138 located at the block rear end 120*b*, at least one and preferably two connector rods 140 attached to the plate(s) 138 and extending axially through the block 120, and a push member 142 located at the block front end 120*a*. The engagement plate(s) 138 are disposed within a pocket(s) (none shown) at the block rear end 120*b* and have one or more edge surfaces 138*a* engageable with a rim of a cartridge case $C_C$. The push member 142 is movably disposed within an opening (not shown) extending into the block front end 120*a*, is manually displaceable inwardly along the axis 4*a* (i.e., by pushing) and is spring-biased toward the front direction. With this structure, when the cylinder 4 is loaded with one or more cartridges C, displacing the push member 142 toward the block rear end 120*b* causes the connector bar(s) to push the attached plate(s) 138 outwardly from the associated pocket. Such movement of the engagement plates 138 causes the edge surface(s) 138*a* to pull the engaged cartridge casings C from the chamber(s) 24, thus extracting the spent cartridges C.

Referring to FIGS. 17 and 19–23, the cartridge retainer housing 18 includes a generally rectangular block 150 having front and rear ends 150*a*, 150*b*, respectively, a central longitudinal axis 152 extending between the two ends 150*a*, 150*b*, opposing top and bottom surfaces 150*c*, 150*d*, and opposing inner and outer side surfaces 150*e*, 150*f*. Preferably, the block 150 has a curved surface section 150*g* extending between the outer side surface 150*f* and the top surface 150*c* and is provided such that the block 150 conforms with the contour of the preferred receiver 2, as best shown in FIG. 10. Further, the housing block 150 also has an inner circumferential surface 154 extending about the axis 152 and defining a generally cylindrical bore 156, which provides the housing chamber 22 as described above, and front and rear openings 158A, 158B each extending into the bore 156. Preferably, a shoulder 159 extends circumferentially and radially into the bore 156 proximal to the block rear end 150*b*, such that the rear opening 158B has a lesser diameter (not indicated) than that of the front opening 158A. With this housing structure, each cylinder 4 is preferably inserted through the front opening 158A of a housing 18 so as to be disposed within the bore 156, and is retained therein by the shoulder 159 at the block rear end 150*b* and at least one retainer 160 at the block front end 150*a*, as described below. When disposed within the bore 156, the cylinder axis 4*a* is collinear with the block axis 152 and the cylinder front and rear ends 120*a*, 120*b* are generally "flush" with the housing front and rear ends 150*a*, 150*b*, respectively. Further, the cylinder outer surface 122 is generally slidably displaceable against the block inner surface 154 when the cylinder block 120 is disposed in the bore 156. Preferably, the block 150 also has a lock opening 157 extending into a block lower surface 150*d* and configured to receive the locking lug 89 from the cartridge assembly locking mechanism 87 to releasably retain or "lock" the cartridge assembly 12 within the receiver cavity 2*a*, as discussed above. Also, the housing block 130 may include a clearance hole (not depicted) extending through the bottom surface 150*d* to provide clearance for the slide tab (not shown) as discussed above.

As best shown in FIG. 21, the housing 18 also includes at least one and preferably two retainers 160 disposed on the block front end 150*a* and are each configured to prevent axial displacement of the cylinder 4 out of the front end 150*a*. Specifically, each retainer 160 extends across and obstructs at least a section of the bore front opening 158A so as to thereby prevent axial movement of the cylinder 4 therethrough. Preferably, each retainer 160 is formed as a plate 161 of any appropriate shape and having a first portion 161*a* attached to or integrally formed with the block 120 and a second portion 161*b* extending across the block front opening 158A. However, the block 150 may include only a single retainer 160, such as a single plate or block extending across the block front end 150*a*, three or more retainers 160, the block 150 may be formed with a "blind" bore 156 with no front opening 158A (i.e., if no shoulder 159 is provided at the rear end 150*b*), such that the no retainer is necessary, etc.

Preferably, the housing 18 further includes a locator member 162 engageable with the cylinder 4 and configured to releasably retain the cylinder 4 at at least one and preferably a plurality of predetermined angular positions about the cylinder axis 4*a*, a separate chamber 24 being aligned with the barrel bore 3*c* at each such position. The locator member 162 is also configured to disengage from the cylinder 4 when the rotator 16 displaces the cylinder 4 about the axis 4*a*, such that the locator member 162 does not impede the functioning of the rotator 16. Preferably, the locator member 162 is pivotally connected with the block 150 and provides the locating lug 164, as mentioned above. More specifically, the locator member 162 is preferably formed as an arcuate cantilever arm 166 having a first end 166*a* attached to the block 150 and a second, free end 166*b*, the lug 164 extending from the arm free end 166*b* and generally toward the housing axis 152. The arm 166 is preferably disposed within an arcuate recess 166 extending through the curved section 150*g* of the block 150 and partially circumferentially with respect to the axis 152. Further, the locator arm 166 is generally pivotable or bendable about the first end 166*a* so as to move generally toward or away from the cylinder axis 4*a* to displace the lug 164 respectively into or out of engagement with the cylinder index notches 26. As such, the cylinder 4 is retained with one chamber 24 aligned with the barrel bore 3*c*, as discussed above.

Furthermore, when the cylinder 4 is rotatably displaced about the axis 4*a* (i.e., by rotator 16) to move an adjacent chamber 24 into alignment with the barrel bore 3*c*, the lug 164 slides from a particular recess 130 and onto the associated lead-out surface 131, then slides along the surface 131 so as to displace radially-outwardly with respect to the axis 152 until the lug 164 is disposed against the cylinder outer surface 122. Thereafter, the lug 164 slides against the cylinder outer surface 122 as the rotator 16 angularly displaces the cylinder 4 until an adjacent notch 26 becomes disposed beneath the lug 164. At which point, the locator arm 166 pivots inwardly to push the lug 164 into the recess 130 so that the cylinder 4 is fixed with respect to the axis 4*a* with the adjacent chamber 24 aligned with the bore 3*c*. Additionally, as the lead-out surface 131 extends from only one side of the recess 130, the locator arm 162 also functions to prevent rotation of the cylinder 4 in one direction (preferably counter clockwise) about the axis 4*a*.

The cartridge retainer housing 18 also preferably includes one or more indexing bars 170 disposed on the block top surface 150*c* and slidably disposeable within corresponding locating slots 78 of the receiver 2, as described above. Alternatively, the indexing bars 170 may be disposed on another section of the block (e.g., bottom surface 150*d*), the housing 18 may be provided with the slots 78 and the receiver 2 may be provided with the bars or lugs 170, etc. The interaction between the bar(s) 170 and slot(s) 78 functions to both properly locate the housing 18 within the receiver cavity 2*a* and to prevent a cartridge assembly from being inserted into an incompatible rifle. In other words, cartridge retainer assembly 12 (as well as the operating mechanism 10) of the present invention is preferably incorporated into different rifle models having various barrel bore diameters, for example .22 caliber, .30 caliber, 8 mm, .45 caliber, etc. If the wrong cartridge retainer assembly 12 was inserted into an incompatible rifle model, a catastrophic failure could occur, particularly if a larger caliber cartridge were to be fired in a model with a smaller caliber barrel (e.g., a .308 caliber cartridge C fired into a .22 caliber bore 3*c*). Thus, each model rifle 56 preferably has receiver slots 78 that are physically different than the slots 78 in all the other models, such as having different slot widths, different numbers of slots 78, or/and different locations with respect to the receiver 2. As such, the width, number or/and location of the indexing bars 170 on each cartridge housing block 150 are constructed so as to be complementary to the locating slots 78 in the receiver 2 of the specific model rifle 56 for which the assembly 12 is intended.

Referring to FIGS. 3, 4, 6 and 7, the firearm 1 preferably further comprises a slide locking mechanism 190 configured to releasably retain or lock the slide 14 in the front position $S_F$, subsequent to cocking the hammer 5 and rotating the cylinder 4, and to release the slide 14 upon "firing" of a cartridge C. Preferably, the locking mechanism 190 basically includes a locking bar 192 configured to engage with the slide locking lug 99, a trip lever 194 configured to release the bar 190 from engagement with the slide lug 99 when the hammer 5 pivots to the strike position $H_S$, and a manual release lever 196 to disengage the bar 190. The locking bar 192 is pivotable about a pin shaft 198 between a first, engaged position (FIGS. 3 and 7), at which the bar front end 192*a* contacts the slide locking lug 99, and a second, nonengaged position (FIGS. 4–6) at which the bar front end 192*a* is spaced generally vertically from (i.e., beneath) the lug 99. In the engaged position, contact between the bar 192 and the lug 99 prevents the slide 14 from displacing toward the rear position $S_R$. Alternatively, when the locking bar 190 is pivoted downwardly to the nonengaged position, the lug 99 is spaced generally above the bar 192 so that the slide 14 is able to displace to the rear position $S_R$. A spring (not depicted) is preferably disposed upon the shaft 198 and is coupled with the locking bar 192 so as to bias the bar 192 toward the engaged position.

Further, the trip lever 194 is coupled with the locking bar 192 and is engageable by the hammer 5 such that the hammer 5 pivots the lever 194, and thereby displaces the bar 192 to the nonengaged position. Specifically, when the hammer 5 displaces from the cocked position $H_C$ to the strike position $H_S$, a tab (not shown) extending from the hammer 5 contacts and pushes the lever 194 so that the locking bar 192 is displaced downwardly, thereby freeing the slide 14 to displace rearwardly. Further, the release lever 196 is also coupled with the locking bar 192 and has a contact portion 196*a* that extends through an opening (not indicated) in the receiver 2. When a user pushes upwardly on the contact portion 196*a*, the release lever 196 pivots the locking bar 192 to the nonengaged position to free the slide 14. Although the above slide locking mechanism structure is preferred, it is within the scope of the present invention to provide any other mechanism or device to releasably retain the slide 14 in the front position $S_F$.

Figure 25:
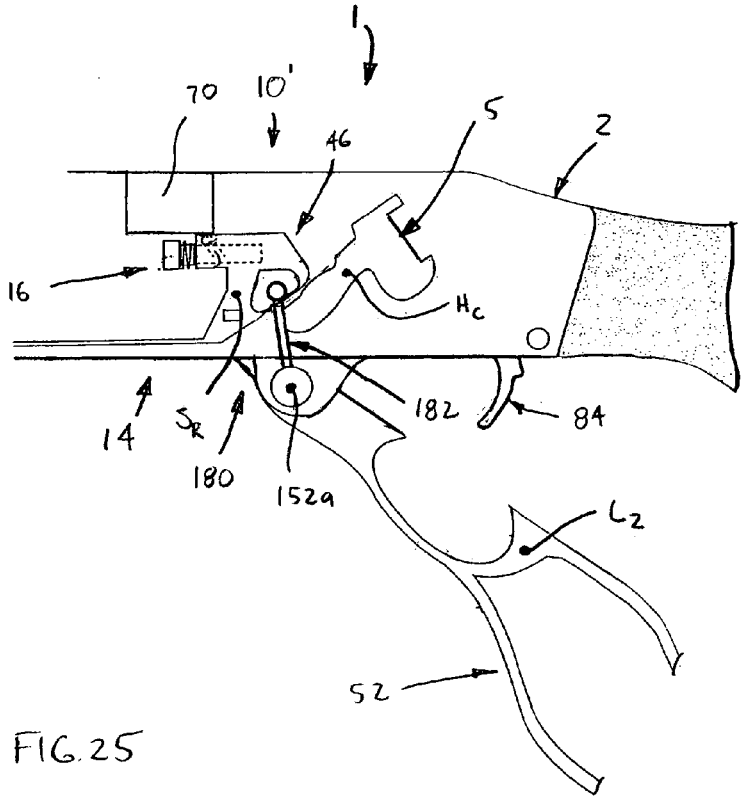
FIG. 25 is another view of the firearm of FIG. 24, showing the operating mechanism in the rear position and the hammer in the cocked position.

Referring to FIGS. 24 and 25, in an alternative, "lever-operated" embodiment of the firearm 1, an operating mechanism 10' is constructed generally identically as the mechanism 10 described in detail above, but with the following differences. Instead of including a slidable grip 50 to displace the slide 14, the operating mechanism 10' includes the pivotable lever 52 to linearly displace the slide 14 between the front and rear positions $S_F$, $S_R$. That is, the lever 52 is pivotable about an axis 52*a* between a first angular position $L_1$ and a second angular position $L_2$ to displace the slide between the two slide positions $S_F$, $S_R$. The operating mechanism 10' further includes a displacement mechanism 180 coupled with the lever 52 and with the slide 14 and configured to linearly displace the slide 14 in response to pivotal movement of the lever 52. Preferably, the displacement mechanism 180 includes a rotatable rod 182 attached to the lever 52 and engaged with the slide block 46 such that the rod 182 pushes or pulls the slide 14 between the front and rear positions $S_F$, $S_R$ when the lever 52 is pivoted. However, the displacement mechanism 180 may include another type of linkage, a rack and pinion mechanism, or any other appropriate mechanism capable of transferring pivotal movement of the lever 52 to linear displacement of the slide 14.

In use, a firearm 1 having an operating mechanism 10 and/or the cartridge retainer assembly 12 of the present invention is operated in basically the following manner. The chambers 24 of one cylinder 4 are each "loaded" with a cartridges C, either prior to or after the cylinder 4 is slided into the chamber of the housing 18. Then, the entire cartridge assembly 12 is installed within the receiver 2 by inserting the housing 18 through the receiver opening 2*b*, while engaging the indexing bars 170 with the receiver locating slots 78, until the entire assembly 12 is disposed within the cavity front portion $2a_1$. At this point, the locking lug 89 of the cartridge assembly locking mechanism 87 is pushed into the locking opening 157 to releasably retain the assembly 12 within the receiver 2. The cartridge assembly 12 is thus positioned with one live chamber 24 aligned with the barrel bore 3*c*.

If the hammer 5 is located in the cocked position $H_C$, the firearm 1 is ready for use, and a user only has to pull the trigger 84 to "fire" the cartridge C in the aligned chamber 24. However, if the hammer 5 is located at the strike position $H_S$, the slide 14 is first displaced (i.e., "pulled") to the rear position $S_R$ so that the slide block drive surface 47 contacts and pushes the hammer 5 to the cocked position $H_C$, and then the slide 14 is displaced to the front position $S_F$, the rotator 16 engaging and rotatably displacing the cylinder 4 about the axis 4*a* such that an adjacent chamber 24 is positioned into alignment with the bore 3*c*. When the cartridge C in the live chamber 24 has been fired, the cycle of displacing the slide 14 to the rear position $S_R$ to cock the hammer 5, and then to the front position $S_F$ to rotate the cylinder 4 to position another chamber 24 into alignment with the barrel bore 3*c*, is repeated until all the cartridges C within the cylinder 4 have been expended. Then, the cartridge retainer assembly 12 is removed from the receiver 12 by first pulling the lock lever 88*b* rearwardly to remove the locking lug 89 from the housing 18, and then slidably displacing the entire assembly 12 through the receiver opening 2*b*. Thereafter, the expended cartridges C (i.e., casings $C_C$) may be removed from the particular cylinder 4 and new cartridges C loaded therein, the cylinder 4 may be removed from the housing 18 and replaced with another, loaded cylinder 4, or another entire cartridge assembly 12 may be placed into the receiver 2.

It will be appreciated by those skilled in the art that changes could be made to the embodiments described above without departing from the broad inventive concept thereof. For example, the firearm 1 may be constructed with the operating mechanism 10 but without the preferred cartridge retainer assembly 12, and vice-versa. Further for example, the present invention may be used with a firearm 1 that includes multiple, interchangeable barrels 3 of different calibers, and thus used with two or more cartridge retainer assemblies 12 of different calibers (e.g., with bores 3*c* of different diameters), as opposed to different sized cartridges of the same caliber. It is understood, therefore, that this invention is not limited to the particular embodiments disclosed, but it is intended to cover modifications within the spirit and scope of the present invention as defined in the appended claims.

I claim:

1. An operating mechanism for a firearm, the firearm having a receiver, a cartridge-containing cylinder disposed at least partially within the receiver so as to be rotatable about an axis, and a hammer movably connected with the receiver so as to be displaceable between a cocked position and a firing pin strike position, the operating mechanism comprising:

a slide movably coupled with the firearm so as to be disposed entirely externally of the cylinder and linearly displaceable between a front position and a rear position, the slide being configured to displace the hammer to the cocked position; and a rotator movably coupled with the slide and configured to releasably engage with and rotatably displace the cylinder about the axis when the slide displaces toward the front position and to alternatively disengage from the cylinder when the slide displaces toward the rear position, the rotator being spaced from the cylinder when the slide is disposed at the rear position.

2. The operating mechanism as recited in claim 1 wherein the slide is configured to displace the hammer to the cocked position when the slide displaces toward the rear position.

3. The operating mechanism as recited in claim 2 wherein the slide is contactable with the hammer as the slide displaces toward the rear position so as to push the hammer to the cocked position.

4. The operating mechanism as recited in claim 1 wherein the receiver has a cavity and the cylinder is removably disposeable within the receiver cavity.

5. The operating mechanism as recited in claim 4 wherein the receiver has a front end, a rear end and at least one sidewall extending between the front and rear ends, the sidewall having an opening extending into the receiver cavity, the cylinder being slidably displaceable through the receiver opening so as to be installed within and alternatively withdrawn from the cavity.

6. The operating mechanism as recited in claim 1 wherein:

the firearm further includes a barrel having a rear end connected with the receiver, an opposing front end and a central bore extending between the front and rear ends;

the cylinder is disposed adjacent to the barrel rear end and has a plurality of chambers, each chamber being configured to receive a separate cartridge and being separately alignable with the barrel bore; and the rotator is configured to successively align each cylinder chamber with the barrel bore.

7. The operating mechanism as recited in claim 6 wherein the rotator displaces the cylinder by a predetermined angular displacement during each engagement with the cylinder so as to move one cylinder chamber out of alignment with the barrel rear opening and to subsequently position an adjacent cylinder chamber into alignment with the barrel bore.

8. The operating mechanism as recited in claim 7 wherein the cylinder has a number of the chambers and the angular displacement has a value of about three hundred sixty degrees divided by the number.

9. The operating mechanism as recited in claim 6 wherein the cylinder has a plurality of index openings and the slide has a lug separately engageable with each one of the index openings when the slide is located at the front position so as to retain a separate one of the cylinder chambers aligned with the barrel bore.

10. The operating mechanism as recited in claim 6 wherein:

the cylinder has a number of the chambers and an opening configured to receive a portion of the rotator, the opening being partially bounded by a generally polygonal inner circumferential surface, the inner surface having the number of surface sections; and the rotator portion has a generally polygonal outer circumferential surface, the rotator outer surface having the number of surface sections, each rotator outer surface section being disposeable generally against a separate one of the cylinder opening inner surface sections when the rotator portion is disposed within the opening.

11. The operating mechanism as recited in claim 1 wherein the cylinder includes a generally circular cylindrical block with front and rear axial ends, the cylinder axis extending centrally through the block between the two axial ends, and the rotator is releasably engageable with the block rear end.

12. The operating mechanism as recited in claim 11 wherein the cylinder block has an engagement opening extending into the block rear end and the rotator has a portion removably disposeable at least within the engagement opening to releasably couple the rotator with the cylinder.

13. The operating mechanism as recited in claim 1 wherein the rotator has a first portion coupled with the slide and second portion releasably engageable with the cylinder.

14. The operating mechanism as recited in claim 1 wherein the rotator is configured to linearly and rotatably displace with respect to the slide when the rotator is engaged with the cylinder such that the rotator angularly displaces the cylinder as the slide displaces toward the front position.

15. The operating mechanism as recited in claim 1 wherein:

the cylinder includes an engagement opening and the slide includes a bore; and the rotator includes a rod, the rod having a first end movably disposed within the slide bore and an opposing second end, and a head connected with the rod second end and removably disposeable at least partially within the cylinder opening to releasably couple the rotator with the cylinder.

16. The operating mechanism as recited in claim 15 wherein the rod is configured to linearly and rotatably displace with respect to the slide when the head is engaged with the cylinder opening such that the head rotatably displaces the cylinder about the cylinder axis as the slide displaces toward the front position.

17. The operating mechanism as recited in claim 16 wherein one of the rod and the slide has a camming surface and the other one of the rod and the slide includes a follower contactable with the camming surface such that linear displacement of the slide with respect to the rod rotatably displaces the head.

18. The operating mechanism as recited in claim 17 wherein:

the rod has a central axis, an outer circumferential surface, and a generally helical recess extending radially inwardly from the outer surface and circumferentially about and linearly along the rod axis, the recess providing the camming surface; and the slide includes a pin having an end disposed within the rod recess and providing the follower.

19. The operating mechanism as recited in claim 16 wherein the rod has a central axis, is displaceable with respect to the slide between first and second linear positions and is rotatably displaceable between first and second angular positions about the rod axis, the rod being configured to displace between the first and second angular positions when displacing with respect to the slide between the first and second linear positions.

20. The operating mechanism as recited in claim 19 wherein the slide displaces along a slide axis between the front and rear positions and when the slide displaces toward the front position with the head in engagement with the cylinder opening, the rotator remains disposed generally at a fixed position with respect to the slide axis as the rod is displaced with respect to the slide from the first linear position to the second linear position while rotating from the first angular position to the second angular position to rotatably displace the cylinder.

21. The operating mechanism as recited in claim 20 wherein the head engages with the cylinder opening when the slide is disposed at an intermediate position during displacement from the rear position to the front position and disengages from the cylinder opening when the slide displaces from the front position toward the rear position.

22. The operating mechanism as recited in claim 21 further comprising a biasing member configured to bias the rod toward the first linear position when the head is disengaged from cylinder opening such that the rod displaces with respect to the slide from the second linear position to the first linear position as the slide displaces toward the rear position.

23. The operating mechanism as recited in claim 19 further comprising a biasing member configured to bias the rotator toward the first axial position.

24. The operating mechanism as recited in claim 1 wherein the slide includes:

an elongated portion having a first end slidably connected with one of the receiver and the barrel and second end; and a block portion connected with the elongated portion second end, having a hole configured to receive at least a portion of the rotator, and being contactable with the hammer such that the block portion pushes the hammer to the cocked position when the slide displaces in the rearward direction.

25. The operating mechanism as recited in claim 24 wherein the elongated portion and the block portion are integrally formed.

26. The operating mechanism as recited in claim 24 further comprising a grip connected with the slide elongated portion and configured to be grasped by a user such that the slide is manually displaceable between the front and rear positions.

27. The operating mechanism as recited in claim 24 wherein the firearm further includes an elongated guide member connected with the receiver and extending generally parallel with respect to the barrel and the slide elongated portion first end is slidably connected with the guide member.

28. The operating mechanism as recited in claim 27 wherein the slide further comprises at least one coupling member connected with the slide elongated portion and having a central opening, the coupling member being slidably disposed upon the guide member such that the guide member extends through the member central opening to slidably couple the slide with the guide member.

29. The operating mechanism as recited in claim 24 wherein:

the firearm further includes a barrel having a rear end connected with the receiver, an opposing front end, a bore extending between the front and rear ends, and a central axis extending longitudinally through the bore; and the slide elongated portion extends generally parallel with respect to the bore axis and is disposed generally beneath the barrel and the cylinder when the firearm is positioned in a firing orientation.

30. The operating mechanism as recited in claim 24 wherein the receiver has a first interior cavity section configured to receive the cylinder, a second interior cavity section configured to receive at least the hammer, and a third interior cavity section disposed generally between the first and second cavity sections and configured to receive the slide block portion.

31. The operating mechanism as recited in claim 30 wherein the slide block portion is displaceable within the third cavity section between a proximal position with respect to the cylinder and a distal position with respect to the cylinder, the rotator being engaged with the cylinder at the proximal position and the block portion being in contact with the hammer at the distal position.

32. The operating mechanism as recited in claim 24 wherein the block portion has a bore configured to receive at least a portion of the rotator.

33. The operating mechanism as recited in claim 25 wherein the block portion has a front end and a rear end, a bore extending inwardly from the front end and toward the rear end and configured to receive a portion of the rotator, and a drive surface disposed on the rear end and contactable with the hammer to displace the hammer to the cocked position when the slide displaces toward the rear position.

34. The operating mechanism as recited in claim 33 wherein when the slide is located at the front position and the hammer is disposed at the strike position, the block rear end is spaced forwardly of the hammer.

35. The operating mechanism as recited in claim 1 wherein the hammer is pivotally connected with the receiver and the slide is contactable with the hammer when the slide displaces toward the rear position so as to pivot the hammer to the cocked position.

36. The operating mechanism as recited in claim 35 wherein the slide is spaced frontwardly with respect to the hammer when the hammer is disposed in the strike position.

37. The operating mechanism as recited in claim 1 wherein the slide includes a grip portion configured to be grasped by a user such that the slide is manually displaceable between the front and rear positions.

38. The operating mechanism as recited in claim 1 further comprising a lever pivotally coupled with the receiver and configured to displace the slide between the front and rear positions.

39. The operating mechanism as recited in claim 38 wherein the lever is pivotally displaceable about an axis and is configured to displace the slide from the front position to the rear position when the lever pivotally displaces from a first angular position and toward a second angular position and to alternatively displace the slide from the rear position to the front position when the lever displaces from the second angular position and toward the first angular position.

40. The operating mechanism as recited in claim 38 wherein the firearm further includes a barrel attached to the receiver, the barrel having a bore with a central longitudinal axis, and the lever extends generally parallel with respect to the barrel axis when located at the first angular position and extends generally perpendicularly with respect to the barrel axis when located at the second angular position.

41. The operating mechanism as recited in claim 1 further comprising a slide locking mechanism configured to releasably retain the slide in the front position when the hammer is disposed at the cocked position and to release the slide when the hammer is disposed at the strike position.

42. The operating mechanism as recited in claim 41 wherein the slide locking mechanism includes:

a pivotal locking bar configured to releasably engage with the slide;

a trip lever configured to release the locking bar from engagement with the slide when the hammer displaces toward the strike position; and a manual release lever configured to release the locking bar from engagement with the slide.

43. A firearm comprising:

a receiver:

a cartridge-containing cylinder disposed at least partially within the receiver so as to be rotatable about an axis, a hammer movably connected with the receiver so as to be displaceable between a cocked position and a firing pin strike position;

a slide movably coupled with the receiver so as to be disposed entirely externally of the cylinder and linearly displaceable between a front position and a rear position, the slide being configured to displace the hammer to the cocked position; and a rotator movably coupled with the slide and configured to releasably engage with and rotatably displace the cylinder about the axis when the slide displaces toward the front position and to alternatively disengage from the cylinder when the slide displaces toward the rear position, the rotator being spaced from the cylinder when the slide is disposed at the rear position.

44. A firearm comprising:

a receiver with an interior cavity and an opening extending into the cavity;

a barrel having a rear end connected with the receiver, an opposing front end, and a bore extending between the front and rear ends;

a housing removably disposeable within the receiver cavity, having an interior chamber, and being displaceable through the receiver opening; and a cylinder rotatably disposed within the housing chamber and having a plurality of chambers, each chamber being configured to receive a separate cartridge and being separately alignable with the barrel bore.

45. An operating mechanism for a firearm, the firearm having a receiver, a cartridge-containing cylinder disposed at least partially within the receiver so as to be rotatable about an axis and including an engagement opening, and a hammer movably connected with the receiver so as to be displaceable between a cocked position and a firing pin strike position, the operating mechanism comprising:

a slide movably coupled with the firearm so as to be and linearly displaceable between a front position and a rear position and configured to displace the hammer to the cocked position, the slide including a bore; and a rotator movably coupled with the slide and configured to releasably engage with and rotatably displace the cylinder about the axis when the slide displaces toward the front position and to alternatively disengage from the cylinder when the slide displaces toward the rear position, the rotator including a rod having a first end movably disposed within the slide bore and an opposing second end and a head connected with the rod second end and removably disposeable at least partially within the cylinder opening to releasably couple the rotator with the cylinder;

wherein the rod is configured to linearly and rotatably displace with respect to the slide when the head is engaged with the cylinder opening such that the head rotatably displaces the cylinder about the cylinder axis as the slide displaces toward the front position.

46. An operating mechanism for a firearm, the firearm having a receiver, a cartridge-containing cylinder disposed at least partially within the receiver so as to be rotatable about an axis, and a hammer movably connected with the receiver so as to be displaceable between a cocked position and a firing pin strike position, the operating mechanism comprising:

a slide movably coupled with the firearm so as to be linearly displaceable between a front position and a rear position, the slide including an elongated portion having a first end slidably connected with one of the receiver and the barrel and second end and a block portion connected with the elongated portion second end, having a hole configured to receive at least a portion of the rotator, and being contactable with the hammer such that the block portion pushes the hammer to the cocked position when the slide displaces in the rearward direction; and a rotator movably coupled with the slide and configured to releasably engage with and rotatably displace the cylinder about the axis when the slide displaces toward the front position and to alternatively disengage from the cylinder when the slide displaces toward the rear position.

47. An operating mechanism for a firearm, the firearm having a receiver, a cartridge-containing cylinder disposed at least partially within the receiver so as to be rotatable about an axis, and a hammer movably connected with the receiver so as to be displaceable between a cocked position and a firing pin strike position, the operating mechanism comprising:

a slide movably coupled with the firearm so as to be disposed entirely externally of the cylinder and linearly displaceable between a front position and a rear position, the slide being configured to displace the hammer to the cocked position and including a grip portion configured to be grasped by a user such that the slide is manually displaced to the rear position when the grip is pulled rearwardly and the slide is manually displaced to the front position when the grip is pushed frontwardly; and a rotator movably coupled with the slide and configured to releasably engage with and rotatably displace the cylinder about the axis when the slide displaces toward the front position and to alternatively disengage from the cylinder when the slide displaces toward the rear position.

* * * * *